US009631350B2

(12) United States Patent
Bekki et al.

(10) Patent No.: US 9,631,350 B2
(45) Date of Patent: Apr. 25, 2017

(54) FLUSH TOILET

(71) Applicant: TOTO LTD., Kitakyushu-shi, Fukuoka (JP)

(72) Inventors: Makoto Bekki, Kitakyushu (JP); Masaaki Inoue, Kitakyushu (JP); Yu Yamasaki, Kitakyushu (JP); Hiroyuki Hara, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 259 days.

(21) Appl. No.: 14/482,625

(22) Filed: Sep. 10, 2014

(65) Prior Publication Data

US 2015/0089730 A1 Apr. 2, 2015

(30) Foreign Application Priority Data

Sep. 30, 2013 (JP) ..... 2013-204202
Dec. 13, 2013 (JP) ..... 2013-258239

(51) Int. Cl.
*E03D 1/14* (2006.01)

(52) U.S. Cl.
CPC ..... *E03D 1/14* (2013.01)

(58) Field of Classification Search
CPC ..... E03D 1/14
See application file for complete search history.

(56) References Cited

U.S. PATENT DOCUMENTS 5,125,120 A * 6/1992 Baron ..... E03D 1/32 137/624.12
6,802,084 B2 * 10/2004 Ghertner ..... E03D 1/00 340/605
6,934,977 B1 * 8/2005 Quintana ..... E03D 1/00 4/366

* cited by examiner

*Primary Examiner* — Janie Loeppke
(74) *Attorney, Agent, or Firm* — Brooks Kushman P.C.

(57) ABSTRACT

A flush toilet has a reservoir tank, a toilet main unit, a water supply apparatus, a water discharge apparatus, and a control device for controlling flushing of the bowl portion of the toilet main unit; wherein this control device includes a time measurement device for measuring the time after the water discharge apparatus has been driven for a predetermined time to discharge flush water, until the water level rises from a dead water level inside the reservoir tank with the water discharge apparatus in an off state to a predetermined stopped water level prior to start of flush; and the driving time of the water discharge apparatus responsive to pressure losses in the toilet main unit is adjusted by comparing the water level rise time measured by the time measurement device with the water level rise time in a standard toilet.

14 Claims, 12 Drawing Sheets

FLUSH TOILET

CROSS-REFERENCE TO RELATED APPLICATIONS

This application claims priority to JP application JP 2013-204202 filed on Sep. 30, 2013, and JP application JP 2013-258239 filed Dec. 13, 2013 the disclosures of which are incorporated in their entirety by reference herein.

TECHNICAL FIELD

The present invention relates to a flush toilet, and more particularly to a flush toilet flushed by stored flush water to discharge waste.

BACKGROUND

For some time, known tank-type flush toilets flushed by stored flush water to discharge waste have included those in which flush water stored in a reservoir tank passes through a water passageway in a toilet main unit to be supplied to a bowl portion from a spout port in the toilet main unit. In such flush toilets, the water passageway in the toilet main unit is formed of porcelain, and because pressure losses in the water passageway fluctuate due to manufacturing errors, etc. in the porcelain water passageway, there are also fluctuations in the instantaneous flow rate, etc. of flush water discharged from a discharge port on the bottom surface of a reservoir tank as the result of these pressure losses. In particular, those toilets in which a discharge valve which opens and closes the discharge port inside the reservoir tank is opened for a fixed time under timer control are directly affected by pressure losses in the water passageway, etc., leading to variability in the amount of flush water discharged from the reservoir tank to the toilet main unit.

Known solutions to such problems include, for example, the one set forth in Patent Document 1 (Japanese Patent Unexamined Publication No. 2012-132167), including a flush control device in which the time is measured for a drop in the water level inside a reservoir tank, from an initial water level prior to start of flush to a predetermined water level, and the spouted flow rate of water spouted from the spout port into the bowl portion of the toilet main unit is adjusted based on this measured water level drop time.

SUMMARY

However, in the conventional flush toilet set forth in the above-described Patent Document 1, the time for measuring the water level drop time from the initial water level before the start of flush until dropping to a predetermined water level (water level drop time) is extremely short (e.g., 0.1-5 seconds), so in fact it is difficult to precisely measure pressure losses in the water passageway of the toilet main unit. In addition, because flush water flows with a strong force when flush water inside the reservoir tank is discharged, waves are formed on the water surface of the flush water stored in the reservoir tank, making accurate detection of pressure losses in the water passageway of the toilet main unit difficult. Therefore in cases where there are manufacturing errors in the subject toilet main unit (e.g., in the water passageway), the problem arises that it is difficult to appropriately adjust valve opening time on a discharge valve using a flush control means in response to pressure losses from one toilet main unit to another, such that toilet flushing performance is compromised, and it is difficult to implement a reliable toilet flush.

A conceivable method for solving the problem of accurately detecting pressure losses in a toilet main unit water passageway is to focus on the water level rise time inside the reservoir tank, which is a relatively long measurement time, using this to detect pressure losses in the water passageway of the toilet main unit.

In such a method, for example, a first water level rise time from the empty state of the reservoir tank until the reservoir tank fills with flush water to a predetermined water level is measured, and the water supply flow rate from the water source to the reservoir tank is calculated using this measured first water level rise time and a pre-determined reservoir tank capacity. Thereafter, a method can be conceived in which a reservoir tank discharge apparatus is driven for a predetermined time, flush water inside the reservoir tank is discharged to a dead water level DWL above the empty state, a second water level rise time from this dead water level DWL until accumulation to a predetermined water level is measured, and pressure losses in the water passageway of the toilet main unit are detected by comparing this second water level rise time to the water level rise time when a pre-calculated water supply flow rate from a water source to the reservoir tank is applied to a reference toilet.

However, in such a method a long time is required from the start of the first water level rise time after the reservoir tank is first temporarily put in an empty state, until pressure losses are detected in the subject toilet main unit, raising the perception of inconvenience to the installer performing the initial settings.

In particular, the larger the capacity of the reservoir tank, the more pronounced is the lengthening of water level measurement time, leading to the problem of a strong perception of inconvenience by the installer.

The present invention was undertaken to solve the above-described problems with the conventional art, and has the object of providing a flush toilet capable of reliably flushing without losses in toilet flush performance, responsive to manufacturing errors in the toilet main unit.

The present invention also has the object of providing a flush toilet capable of detecting pressure losses in the subject toilet main unit in a short time period, and capable of accurately detecting an exact water supply flow rate without being influenced by fluctuations in supply water pressure.

In order to accomplish the above objectives, the present invention is a flush toilet flushed by stored flush water to discharge waste, comprising: a reservoir tank for storing flush water; a toilet main unit including a water passageway for directing flush water supplied from the reservoir tank, a bowl portion connected to this water passageway, in which a spout port is formed, and a discharge trap pipe; a water supply apparatus for supplying flush water from a water source into the reservoir tank; a water discharge apparatus for supplying flush water stored in the reservoir tank to a water passageway in the toilet main unit; and a flush control device for controlling the flushing of the bowl portion by driving the water discharge apparatus to supply flush water stored in the reservoir tank through the water passageway to the spout port; wherein the flush control device includes a time measurement device for measuring the water level rise time from a state in which the water discharge apparatus is turned off until a predetermined water level is reached inside the reservoir tank, after the water discharge apparatus is driven for a predetermined time to discharge flush water, and an adjustment device for adjusting the driving time of the water discharge apparatus in response to pressure losses in the toilet main unit using the water level rise time measured by this time measurement device.

In the invention thus constituted, in order to adjust the driving of the water discharge apparatus responsive to pressure losses in the toilet main unit, the flush control device measures the rise time for the water level inside the reservoir tank with the water discharge apparatus in an off state until it rises to a predetermined water level, hence a longer measurement time can be secured compared to the conventional art in which a measurement is made of the water level drop time for the water level to drop from a predetermined initial water level inside the reservoir tank prior to start of flushing down to the water level when the water discharge apparatus in an off state; therefore a measurement can be made of the water level inside a stable reservoir tank with no waves on the water surface. Therefore pressure losses in the subject toilet main unit (e.g., water passageway pressure losses) can be accurately detected, and an appropriate adjustment of the driving of the water discharge apparatus can be made in response to pressure losses in each toilet main unit. Since driving of the water discharge apparatus can be appropriately adjusted by the flush control device in response to pressure losses in each toilet main unit even if manufacturing errors have occurred in the subject toilet main unit, toilets can be reliably flushed without loss of flushing performance. Moreover, wasted flush water can be decreased and water conserved.

In the present invention, after the water discharge apparatus has been driven for a predetermined time to discharge flush water, the time measurement device preferably measures a first water level rise time for the rise from the water level inside the reservoir tank with the water discharge apparatus in an off state until reaching a predetermined initial water level prior to start of flush.

In the invention thus constituted, in order to adjust the driving time of the water discharge apparatus in response to pressure losses in the toilet main unit, the time measurement device measures a first water level rise time for the rise from the water level inside the reservoir tank with the water discharge apparatus in an off state until reaching a predetermined initial water level prior to start of flush, therefore a longer time for measurement can be secured using a simpler structure compared to the case in which a time measurement device measures the time for the water level to drop from a predetermined water level inside the reservoir tank prior to start of flush down to the water level with the water discharge apparatus in an off state. Therefore the water discharge apparatus driving time can be more precisely adjusted in response to pressure losses in the toilet main unit. Also, because the driving time of the water discharge apparatus can be more precisely adjusted by the flush control device in response to pressure losses in each toilet main unit even if manufacturing errors have occurred in the subject toilet main unit, toilets can be more reliably flushed without loss of flushing performance. Moreover, wasted flush water can be decreased and water conserved.

In the present invention the adjusting device preferably adjusts the driving time of the water discharge apparatus in response to pressure losses in the toilet main unit by comparing the first water rise time measured by the time measurement device with the water level rise time in a standard toilet.

In the invention thus constituted, pressure losses in the subject toilet main unit (e.g., pressure losses in the water passageway) can be more accurately detected by comparing the first water rise time measured by the time measurement device with the water level rise time in a standard toilet, and a water discharge apparatus driving time can be appropriately adjusted in response to pressure losses in each toilet main unit. Since the driving time of the water discharge apparatus can be appropriately adjusted by the flush control device in response to pressure losses in each toilet main unit even if manufacturing errors have occurred in the subject toilet main unit, toilets can be more reliably flushed without loss of flushing performance. Moreover, wasted flush water can be decreased and water conserved.

In the present invention the flush control device furthermore preferably drives the water discharge apparatus for a predetermined time and places the interior of the reservoir tank in an empty state, then, using the time measurement device, measures a second water level rise time for the rise in the water level inside the reservoir tank from a water discharge apparatus off state, until the water level rises to a predetermined initial water level, wherein the water level rise time in the standard toilet is determined from a first water supply flow rate calculated from the second water level rise time and the capacity of the reservoir tank.

In the invention thus constituted, the water supply apparatus is driven for a predetermined driving time and the reservoir tank deemed placed an empty state, after which the time measurement device measures a second water level rise time from the water discharge apparatus off state until the water level inside the reservoir tank rises to a predetermined initial water level; the water level rise time in a standard toilet is determined from a first water supply flow rate calculated from this second water level rise time and the reservoir tank capacity, and the water discharge apparatus driving time in response to toilet main unit pressure losses is more accurately adjusted by comparing this first water level rise time and the water level rise time in the standard toilet. Also, because the driving time of the water discharge apparatus can be more precisely adjusted by the flush control device in response to pressure losses in each toilet main unit even if manufacturing errors have occurred in the subject toilet main unit, toilets can be more reliably flushed without loss of flushing performance. Moreover, wasted flush water can be decreased and water conserved.

In the present invention the flush control device preferably continuously executes the respective measurements of the second water level rise time and first water level rise time by the time measurement device, turning off the water supply apparatus before the respective measurements, then activating the water discharge apparatus and starting the supply of flush water into the reservoir tank.

In the invention thus constituted, by activating the water supply apparatus in an off state before respectively measuring the second water level rise time and first water level rise time using a time measurement device, then starting the supply of flush water into the reservoir tank, fluctuations in the first water supply amount into the reservoir tank by the water supply apparatus (dropping of the first water supply flow rate due to continuous supplying of water) can be prevented, and the water level rise inside the reservoir tank can be stabilized. Therefore the second water level rise time and first water level rise time can be respectively precisely measured, and a water discharge apparatus driving time responsive to pressure losses in the toilet main unit can be more precisely adjusted. Also, because the driving time of the water discharge apparatus can be more precisely adjusted by the flush control device in response to pressure losses in each toilet main unit even if manufacturing errors have occurred in the subject toilet main unit, toilets can be more reliably flushed without loss of flushing performance. Moreover, wasted flush water can be decreased and water conserved.

In the present invention the flush control device preferably again drives the water discharge apparatus for a predetermined time to place the inside of the reservoir tank in an empty state after calculating the first water supply flow rate, then measures a third water level rise time for the water level to rise from the water discharge apparatus off state to the predetermined initial water level inside the reservoir tank using the time measurement device, calculates a second water supply flow rate from this measured third water level rise time and the capacity of the reservoir tank and compares this second water supply flow rate with the first water supply flow rate, and when the second water supply flow rate is equal to or essentially equal to the first water supply flow rate, sets the second water supply flow rate as the water supply flow rate to be used, and when the second water supply flow rate differs greatly from the first water supply flow rate, sets a specified value water supply flow rate with which sufficient flushing capability can be obtained in view of pressure losses in the toilet main unit.

In the invention thus constituted, even if, after calculating the first water supply flow rate, there are fluctuations in the water supply flow rate up until the second water supply flow rate is calculated, and the second water supply flow rate differs greatly from the first water supply flow rate, a setting can be made to a specified value water supply flow rate at which sufficient flushing capability can be secured in view of pressure losses in the toilet main unit, therefore a driving time for the water discharge apparatus can be determined. Therefore the water discharge apparatus driving time can be adjusted in response to pressure losses in the toilet main unit. Since the driving time of the water discharge apparatus can be adjusted by the flush control device in response to pressure losses in each toilet main unit even if manufacturing errors have occurred in the subject toilet main unit, toilets can be more reliably flushed without loss of flushing performance. Moreover, wasted flush water can be decreased and water conserved.

In the present invention the flush control device preferably further includes a notification device for informing a user that appropriate control is not being implemented when a preset value for water supply flow rate has been set.

In the invention thus constituted, a user can be informed by a notification device that an appropriate control is not being implemented, and a flush toilet capable of securing a preset value of water supply flow rate for a flush capability which accounts for pressure losses in the toilet main unit can be activated to perform a reliable toilet flush.

In the present invention the flush control device preferably further includes a water supply flow rate measurement device for measuring the flow rate of flush water supplied from the water supply apparatus to the reservoir tank during a rise in the water level, and the adjusting device adjusts the driving time of the water discharge apparatus in response to pressure losses in the toilet main unit using the first water level rise time measured by the time measurement device, and the water supply flow rate measured by the water supply flow rate measurement device.

In the invention thus constituted, because the water supply flow rate of water supplied to the reservoir tank is measured by a water supply flow rate measurement device during the period when the rise time from the water level with the water discharge apparatus in an off state to a predetermined water level is being measured by a time measurement device in the flush control device, it is possible, with respect to the water supply flow rate from a water source to a reservoir tank, for example, to detect pressure losses in the subject toilet main unit in a shorter time compared to measurement using a combination of the time required for water to accumulate in the reservoir tank starting from a temporarily emptied state and a predetermined reservoir tank capacity, therefore an accurate water supply flow rate can be precisely detected without being influenced by fluctuations in supply water pressure. Therefore driving of a water discharge apparatus in response to pressure losses in each toilet main unit can be appropriately adjusted using an adjusting device, and the need to keep installers waiting for long time periods to make initial settings at the time of flush toilet installation can be eliminated.

In the present invention the water supply flow rate measurement device preferably includes an upper water level sensor disposed within the reservoir tank, and a lower water level sensor disposed below the upper water level sensor; wherein a second water level rise time is a measurement of the time to rise from the water level sensed by the lower water level sensor to the water level sensed by the upper water level sensor, and the water supply flow rate is calculated from this second water level rise time and the reservoir tank capacity.

In the invention thus constituted, the water level to which the water rises when being measured by the time measurement device is sensed by the upper water level sensor and lower water level sensor, and the water supply flow rate measurement device calculates the water supply flow rate, so the water supply flow rate can be measured in the same step as the measurement step by the time measurement device. Therefore compared to measurement using the measured time for water to accumulate in the reservoir tank from a temporarily empty reservoir tank state and a predetermined reservoir tank capacity, pressure losses in the subject toilet main unit can be detected in a short period of time. Also, because pressure losses in the subject toilet main unit are being measured using the water supply flow rate measured by a time measurement device, a more precise detection is possible.

In the present invention the water level detected by the lower water level sensor is preferably positioned above the water level in the reservoir tank with the water discharge apparatus stopped after the flush control device drives the water discharge apparatus for a predetermined time to discharge flush water.

In the invention thus constituted, because the lower water level sensor detects a water level above the water level inside the reservoir tank when the water discharge apparatus turned off, a second water level rise time can be accurately measured even when the water level fluctuates with the water discharge apparatus in an off state. Therefore compared to measurement using the measured time for water to accumulate in the reservoir tank from a temporarily empty reservoir tank state and a predetermined reservoir tank capacity, pressure losses in the subject toilet main unit can be detected in a short period of time, and an accurate water supply flow rate can be precisely detected without being influenced by fluctuations in water supply pressure.

In the present invention the water level detected by the upper water level sensor is preferably positioned at the same position as a predetermined water level in the reservoir tank risen from the water discharge apparatus in an off state after the flush control device drives the water discharge apparatus for a predetermined time to discharge flush water.

In the invention thus constituted, because the predetermined water level detected by the time measurement device and the water level detected by the upper sensor of the water supply flow rate measurement device are the same, both measurements can be completed simultaneously. Therefore compared to measurement using the measured time for water to accumulate in the reservoir tank from a temporarily empty reservoir tank state and a predetermined reservoir tank capacity, pressure losses in the subject toilet main unit can be detected in a short period of time.

In the present invention the water supply flow rate measurement device preferably includes a flow rate sensor for sensing the flow rate when flush water is supplied from the water supply apparatus to the reservoir tank, and the water supply flow rate may also be measured using this flow rate sensor.

In the invention thus constituted, the water supply flow rate is measured by sensing with a flow rate sensor at the time of measurement with a time measurement device, so the water supply flow rate can be measured in the same step as the time measurement step by the time measurement device. Therefore compared to measurement using the measured time for water to accumulate in the reservoir tank from a temporarily empty reservoir tank state and a predetermined reservoir tank capacity, pressure losses in the subject toilet main unit can be detected in a short period of time. Also, because pressure losses in the subject toilet main unit are being measured using water supply flow rate when measuring by a time measurement device, precise detection is possible.

In the present invention the predetermined water level inside the reservoir tank is preferably a predetermined initial water level prior to start of flush.

In the invention thus constituted, the fact that a predetermined water level risen to from a water discharge apparatus off state is the predetermined initial water level enables the toilet to be placed in an initial state when measurements by the time measurement device and water supply flow rate measurement device are completed, therefore the toilet can be more quickly placed in an operable state.

In the present invention the adjusting device preferably adjusts the driving time of the water discharge apparatus in response to pressure losses in the toilet main unit by comparing the water level rise time in a standard toilet determined by water supply flow rate with a first water level rise time measured by the time measurement device.

In the invention thus constituted, pressure losses in the subject toilet main unit can be more accurately detected by having the adjusting device compare the first water rise time measured by the time measurement device with the water level rise time in a standard toilet, and the water discharge apparatus driving time can be appropriately adjusted by the adjusting device in response to pressure losses in each toilet main unit.

Using the flush toilet of the present invention, reliable toilet flushing responsive to manufacturing errors in the toilet main unit can be achieved without loss of toilet performance.

Using the flush toilet of the present invention, pressure losses in the subject toilet main unit can be detected in a short time period, and an accurate water supply flow rate can be precisely detected without being influenced by fluctuations in supply water pressure.

DETAILED DESCRIPTION

Below, referring to the attached figures, we explain a flush toilet according to a first embodiment of the invention.

Figure 1:
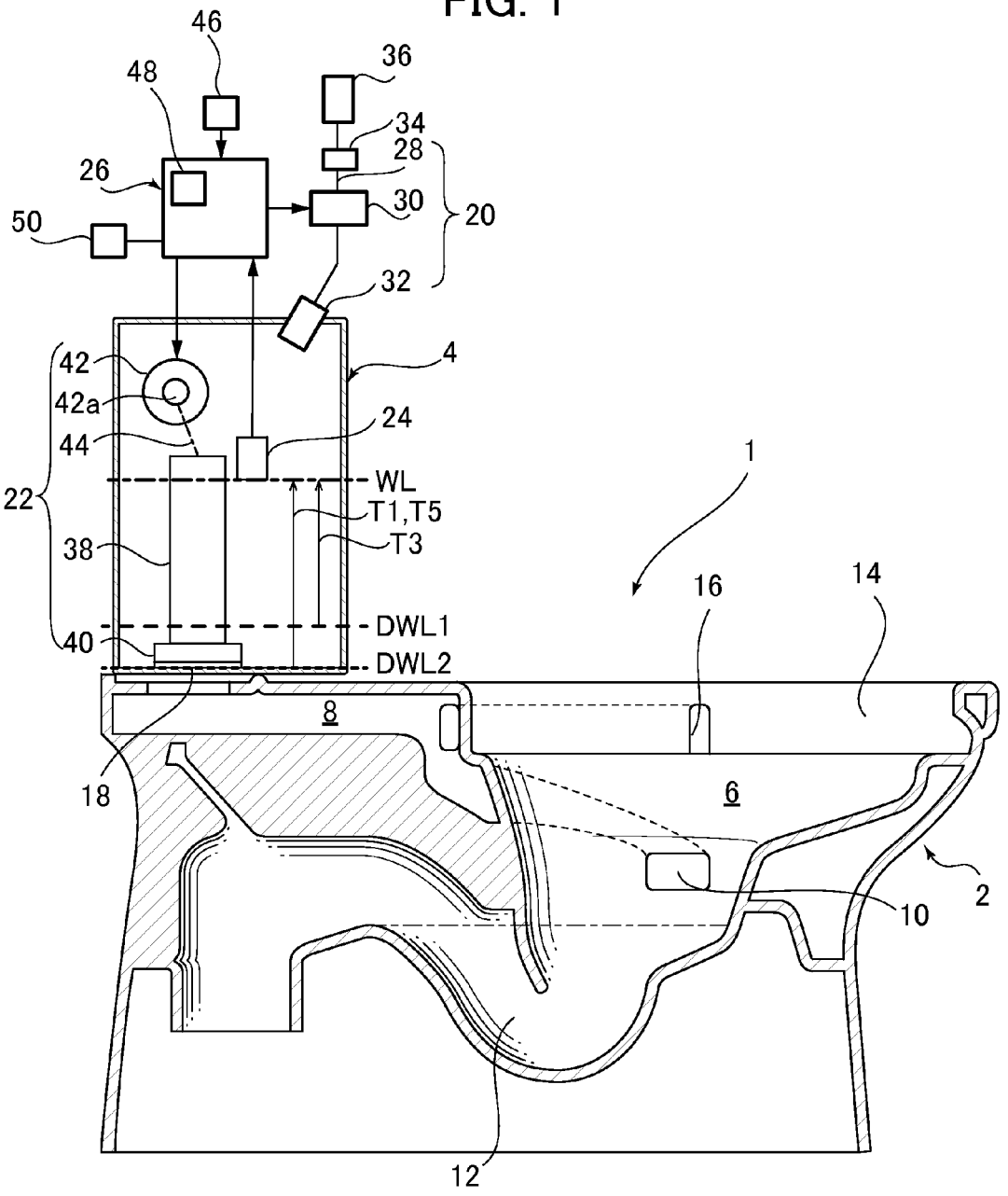
FIG. 1 is a schematic diagram of a flush toilet according to a first embodiment of the present invention.

First, FIG. 1 is a summary diagram of a flush toilet according to a first embodiment of the present invention.

As shown in FIG. 1, reference numeral 1 indicates a flush toilet according to a first embodiment of the present invention. This flush toilet 1 comprises a porcelain toilet main unit 2 and a reservoir tank 4 attached to the rear portion of this toilet main unit 2, for storing flush water used in toilet flushing and supplying same to toilet main unit 2, and is a "wash down" flush toilet in which flush water supplied from reservoir tank 4 and pushes out waste by the flow action caused by the head of water in bowl portion 6 of toilet main unit 2.

As shown in FIG. 1, a bowl portion 6 is formed on the front side at the top portion of toilet main unit 2; a water passageway 8 is formed on the top portion at the rear side of bowl portion 6. A spout port 10 through which flush water is supplied from water passageway 8 is formed on the center bottom portion of bowl portion 6, and flush water supplied into water passageway 8 from reservoir tank 4 is guided to spout port 10 in bowl portion 6. There is also a discharge trap pipe 12 communicating with bowl portion 6 formed under water passageway 8, so that flush water from spout port 10 is spouted toward discharge trap pipe 12.

As shown in FIG. 1, an overhang-shaped rim 14 is formed on the top edge portion of bowl portion 6 of toilet main unit 2; a rim spout port 16 to which flush water is supplied from water passageway 8 is formed on this overhang-shaped rim 14, so that flush water can descend as it swirls and flush out bowl portion 6.

A discharge port 18 communicating with water passageway 8 in flush toilet 1 and discharging flush water in reservoir tank 4, is formed on the bottom portion of reservoir tank 4, positioned at the top of water passageway 8 in toilet main unit 2.

As shown in FIG. 1, flush toilet 1 of the embodiment comprises a water supply apparatus 20 for supplying flush water into reservoir tank 4 from a water source such as municipal water, etc., and a discharge apparatus 22 for discharging flush water stored in reservoir tank 4 to water passageway 8 in toilet main unit 2 from discharge port 18. In addition, flush toilet 1 comprises a float switch 24, being a water level sensor for sensing the water level inside reservoir tank 4, and a control device 26 for controlling the operation of water supply apparatus 20 and discharge apparatus 22, etc. based on water level information sensed by this float switch 24.

As shown in FIG. 1, water supply apparatus 20 comprises, starting from the upstream side, a water supply pipe 28, a water supply valve 30, and a water supply port 32.

A fixed flow rate valve 34 is installed on the upstream side of water supply pipe 28, and a stop cock 36 is installed on the upstream side of this fixed flow rate valve 34; the upstream side of this stop cock 36 is connected to an external water supply source such as municipal water, etc. (not shown).

Water supply valve 30 consists of an electromagnetic valve; the opening and closing operation of water supply valve 30 is controlled by instructions from control device 26 based on water level sensing information from float switch 24, which detects the water level inside reservoir tank 4, to switch between supplying or shutting off flush water into reservoir tank 4 from water supply port 32 on water supply apparatus 20.

Next, as shown in FIG. 1, discharge apparatus 22 comprises a flush water volume regulator 38, a valve member 40 integrally disposed on the bottom portion of this overflow pipe 38, and a rotary drive apparatus 42; the top end portion of overflow pipe 38 is connected to rotary shaft 42*a* of rotary drive apparatus 42 through ball chain 44.

A motor (not shown) for driving rotary shaft 42*a* is built into rotary drive apparatus 42; the operation of this motor is controlled by control device 26.

Moreover, as shown in FIG. 1, control device 26 is connected to an operating button 46 by which a user gives instructions to flush. When a signal from a user's operation of operating button 46 is sent to control device 26, the motor (not shown) in rotary drive apparatus 42 operates, rotary shaft 42*a* rotates, and overflow pipe 38 and valve member 40 move up or down according to the direction of rotation of rotary shaft 42*a*. More specifically, when rotary shaft 42*a* rotates in a predetermined direction, overflow pipe 38 and valve member 40 are pulled upward together with ball chain 44 for a predetermined time, and discharge port 18 is opened.

The longer the time is during which overflow pipe 38 and valve member 40 are held in a raised state, the longer is the valve opening time on discharge apparatus 22, and to that extent the amount of flush water discharged from reservoir tank 4 to water passageway 8 on toilet main unit 2 is increased.

On the other hand, when rotary shaft 42*a* is rotated in the opposite direction from the predetermined direction, overflow pipe 38 and valve member 40 drop together with the drop in water level within reservoir tank 4, and discharge port 18 is closed by valve member 40.

Note that in discharge apparatus 22 of flush toilet 1 of the embodiment, we explain what is known as the direct drive type of discharge valve, in which overflow pipe 38 and valve member 40 move up or down by the driving of rotary shaft 42*a* by rotary drive apparatus 42, thereby opening and closing discharge port 18, but a flapper-type of discharge valve configuration may also be applied, as may a configuration in which water is discharged by a pump.

Here, as shown in FIG. 1, the level of flush water remaining in reservoir tank 4, when discharge port 18 is opened and valve member 40 closes discharge port 18 with the water level inside valve member 40 in a dropped state, is the dead water level DWL1. In a normal flushing operation of flush toilet 1, when the water level inside reservoir tank 4 rises from the dead water level DWL1 state to stopped water level WL, at which the water level in the reservoir tank contacts float switch 24 due to the supply of water by water supply apparatus 20, the supply of water by water supply apparatus 20 is stopped. It also happens that the water level DWL2 inside reservoir tank 4 in FIG. 1 indicates the water level with reservoir tank 4 in an empty state (DWL2=0). The time to rise from the dead water level DWL1 in reservoir tank 4 to stopped water level WL is approximately 25 to 75 seconds.

Control device 26 controls the driving of rotary shaft 42*a* on rotary drive apparatus 42 in response to a flush mode instruction from operating button 46; the amount of flush water discharged from reservoir tank 4 discharge port 18 into toilet main unit 2 water passageway 8 is controlled by raising valve member 40 to control the valve opening time during which reservoir tank 4 discharge port 18 is opened. Also note that operating button 46 comprises a flush mode switching button (not shown) for selecting and switching between three flush modes: "large flush mode," which flushes with the largest amount of flush water; "small flush mode," which flushes with a lesser amount of flush water than the large flush mode, and "eco small flush mode," which flushes with less flush water than the small flush mode.

With respect to the amount of flush water discharged from reservoir tank 4 discharge port 18 to water passageway 8 on toilet main unit 2, in the present embodiment three selections of toilet flushes, the large flush mode, small flush mode, and eco small flush mode, are possible by setting the positions for raising valve member 40 on discharge apparatus 22 to a high, medium, or low position, but without limitation to 3 selections, a toilet implementing only a large flush mode is feasible, as is a toilet implementing two flush modes: the large flush mode and the small flush mode.

In addition, control device 26 comprises a time measurement device 48 capable of measuring the water level rise time when the water level inside reservoir tank 4 is rising, and is capable of performing a control based on the water level rise time measured by this time measurement device 48 to sense pressure losses in toilet main units 2 installed at various installation sites, described in detail below ("toilet pressure loss learning control" below).

Then, after flush toilet 1 has been installed at an individual installation site and before substantive use of the toilet begins, this can function as an adjustment device for appropriately adjusting the driving time of rotary drive apparatus 42 on discharge apparatus 22 and the valve opening time on valve member 40 in response to pressure losses (in particular, pressure losses in water passageway 8, etc.) in toilet main unit 2 for each flush toilet 1.

Moreover, control device 26 comprises a notification device 50 for informing users of the abnormal state that appropriate toilet pressure loss learning control has not been carried out, by flashing an LED display or the like.

Next, referring to FIGS. 2 through 6, we explain the content of toilet pressure loss learning control by a flush toilet control device according to a first embodiment of the present embodiment.

Figure 2:
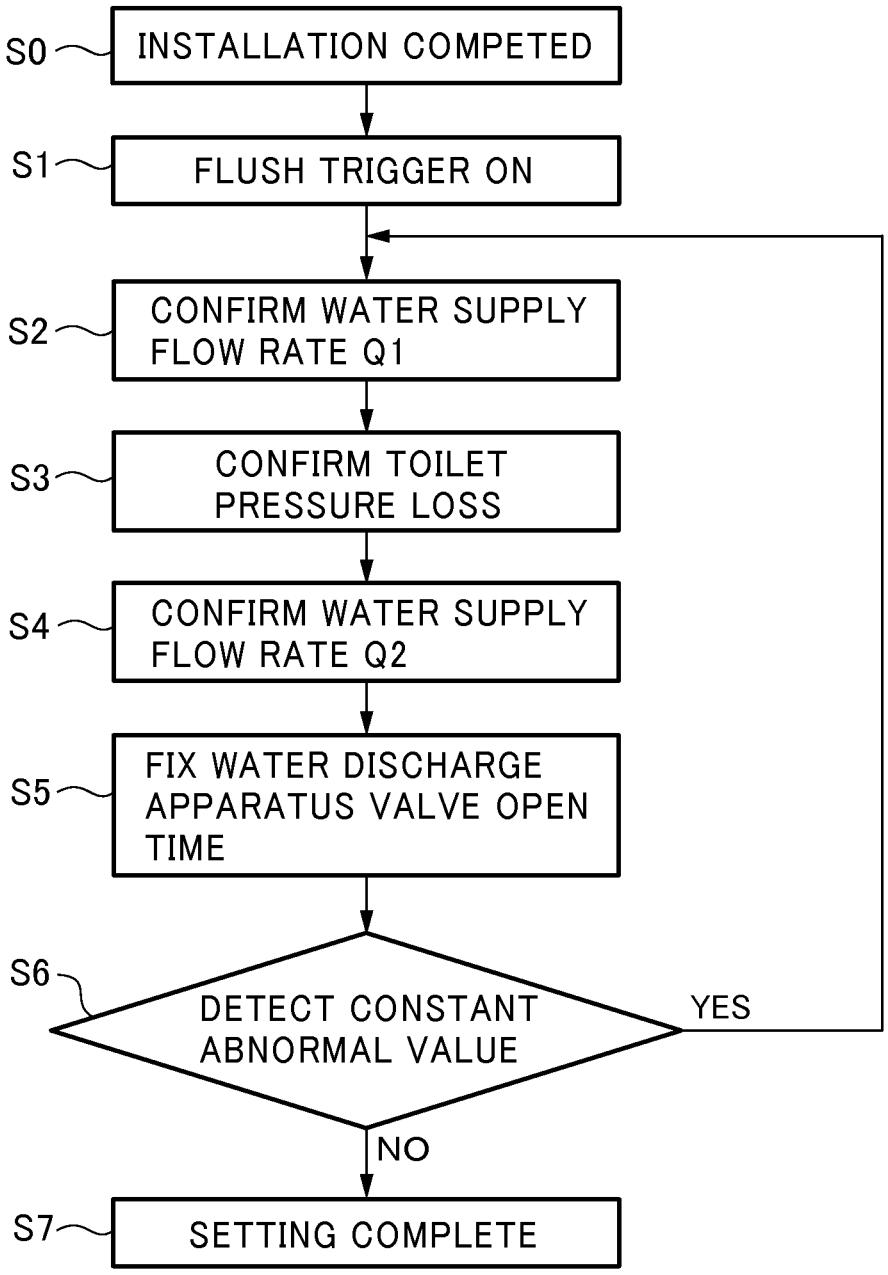
FIG. 2 is a flow chart showing the content of toilet pressure loss learning control using a flush toilet control apparatus according to a first embodiment of the present invention.
Figure 3:
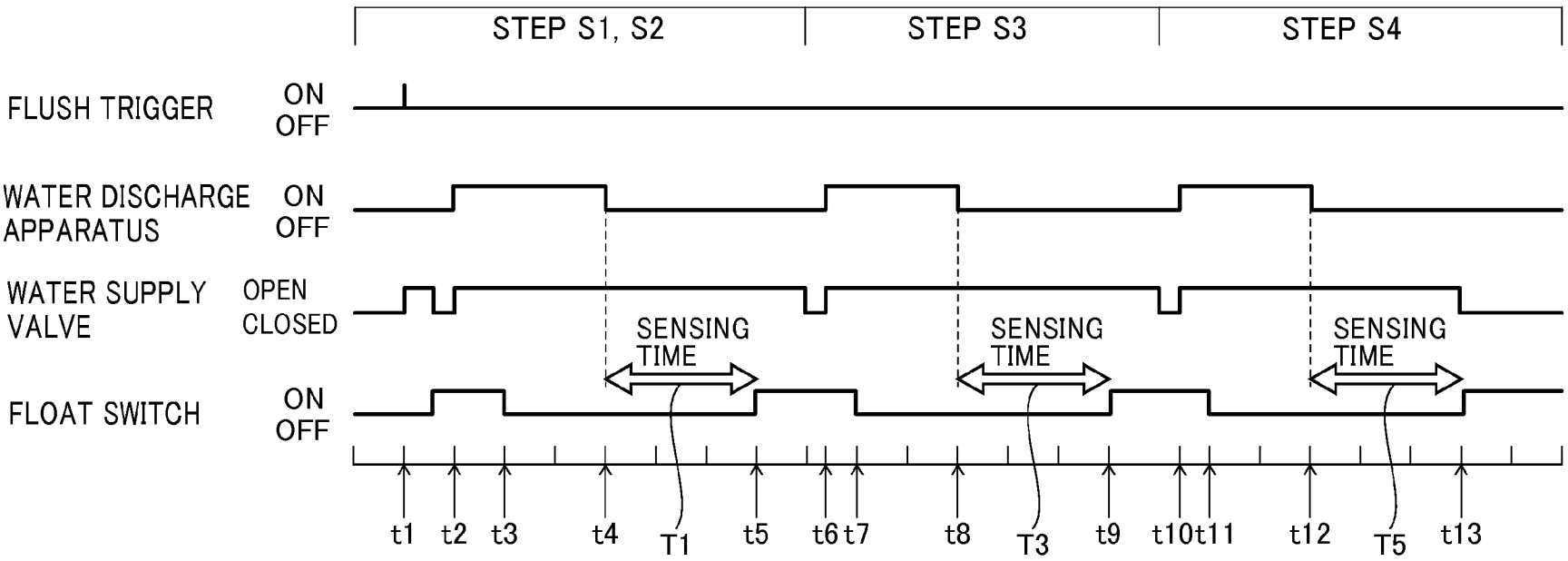
FIG. 3 is a timing chart showing the operation of a flush toilet according to a first embodiment of the present invention.

FIG. 2 is a flow chart showing the content of toilet pressure loss learning control using a flush toilet control apparatus according to a first embodiment of the present invention; FIG. 3 is a timing chart showing the operation of a flush toilet according to a first embodiment of the present invention.

As shown in FIGS. 2 and 3, in FIG. 2, step S0, a flush toilet 1 of the present embodiment is first installed at a predetermined installation site, and when installation is completed a flush test is performed in FIG. 2, step S1. In the flush test, at FIG. 1 time t1, the flush trigger is turned on regardless of which of the flush mode switch buttons (not shown) is pushed among the large flush mode, small flush mode, and eco small flush mode on operating button 46. At time t1 in FIG. 3, water supply valve 30 is opened and reservoir tank 4 is full; when water supply valve 30 is closed for a predetermined time after float switch 24 is turned on, the supply of water is stopped. Thereafter, water supply valve 30 is again opened at time t2 in FIG. 30.

In the same way as above, water supply valve 30 is closed for a predetermined time and the supply of water stopped between steps S1, S2 and step S3 (a predetermined time immediately before time t6 in FIG. 3) and between step S3 and step S4 (a predetermined time immediately before time t10 in FIG. 3).

In other words, before steps S1, S2, step S3, and step S4 are respectively executed and a specified measurement by time measurement device 48 is performed, water supply valve 30 is closed for a predetermined time, placing water supply apparatus 20 in an off state; by subsequently operating this and starting the supply of flush water into reservoir tank 4, the behavior of fixed flow rate valve 34 on the upstream side of water supply apparatus 20 is stabilized, and variability is suppressed until time t13 in FIG. 3.

Then, in step S2 of FIG. 2, a calculation is made of first water supply flow rate Q1, supplied from water supply port 32 on water supply apparatus 20 to reservoir tank 4.

Figure 4:
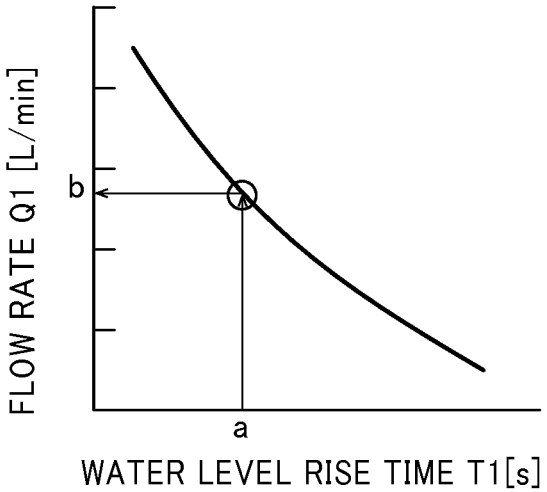
FIG. 4 is a characteristic diagram (relational diagram between reservoir tank water level rise time T1 and water supply apparatus first water supply flow rate Q1) for calculating, under toilet pressure loss learning control, a first water supply flow rate Q1 from the water level rise time T1 for the water level inside the reservoir tank to rise from a water discharge apparatus closed valve state, after the water level inside the reservoir tank is emptied, to an initial water level prior to start of flush (stopped water level WL).

Next, referring to FIGS. 1 and 3 and FIG. 4, we explain the method for calculating first water supply flow rate Q1 in step S2 of FIG. 2.

FIG. 4 is a characteristic diagram (relational diagram between reservoir tank water level rise time T1 and water supply apparatus 20 first water supply flow rate Q1) for calculating, under toilet pressure loss learning control, a first water supply flow rate Q1 from the water level rise time T1 (see FIG. 1) until the water level inside reservoir tank 4 rises from the water discharge apparatus 22 closed valve state, after the water level inside reservoir tank 4 is emptied, to an initial water level prior to start of flush (stopped water level WL).

In step S2, water supply valve 30 is opened for a predetermined time, with discharge apparatus 22 closing discharge port 18 at time t1 in FIG. 3; water is supplied from water supply port 32 into reservoir tank 4 for a predetermined time, and the water level inside reservoir tank 4 rises up to the water level at which it contacts float switch 24 (stopped water level WL) at time t2 in FIG. 3. Float switch 24 then turns on, following which, when water supply valve 30 is closed for a predetermined time, discharge apparatus 22 is driven to open discharge port 18 at time t2 in FIG. 3, such that the water level inside reservoir tank 4 drops, and float switch 24 turns off at time t3 in FIG. 3.

Even if the supply of water by water supply apparatus 20 is continuing, the speed at which the water level inside reservoir tank 4 drops greatly exceeds the speed at which the water level rises by supplying water, therefore the water level inside reservoir tank 4 goes to an empty state (DWL2=0) (see DWL2 in FIG. 1). Thereafter, at time T4 in FIG. 3, discharge apparatus 22 again closes discharge port 18 when the water level inside reservoir tank 4 is in an empty state (DWL2=0).

At this point, at time T4 in FIG. 3, discharge apparatus 22 closes discharge port 18, and simultaneously time measurement device 48 in control device 26 measures water level rise time T1 (=t5−t4) for the water level inside reservoir tank 4, from time T4 until rising to the initial water level (stopped water level WL) at time t5, prior to start of flush (see T1 in FIG. 1 and FIG. 3). At time t5 in FIG. 3, float switch 24 goes from on to off In the present embodiment, a measurement is being made of the water level rise time T1 (=t5−t4) from time T4 when the water level inside reservoir tank 4 starts to rise up to the initial water level (stopped water level WL) t5 before start of flush, but it is also acceptable to measure the time for the water level to rise up to a predetermined water level below the initial water level, or to a predetermined water level above the initial water level, rather than to the initial water level itself.

Here, as shown in FIG. 4, assuming the water level rise time T1 measured by time measurement device 48 from time T4 to time t5 in FIG. 3 was a [s], applying this water level rise time T1 (=a [s]) to the relational diagram between the reservoir tank water level rise time T1 experimentally obtained in advance and shown in FIG. 4, and first water supply flow rate Q1, we can calculate first water supply flow rate Q1 (=b [L/min]) and store this calculated data, thus completing step S2 in FIG. 3.

Note that first water supply flow rate Q1, calculated by applying the water level rise time T1 measured by time measurement device 48 to FIG. 4, can also be calculated from the measured water level rise time T1 and the capacity of reservoir tank 4.

Next, in step S3 after step S2 in FIG. 3, we confirm the pressure losses in flush toilet 1. Below we explain in concrete terms the method for confirming pressure losses in this flush toilet 1 using FIG. 1, FIG. 3, and FIGS. 5 and 6.

Figure 5:
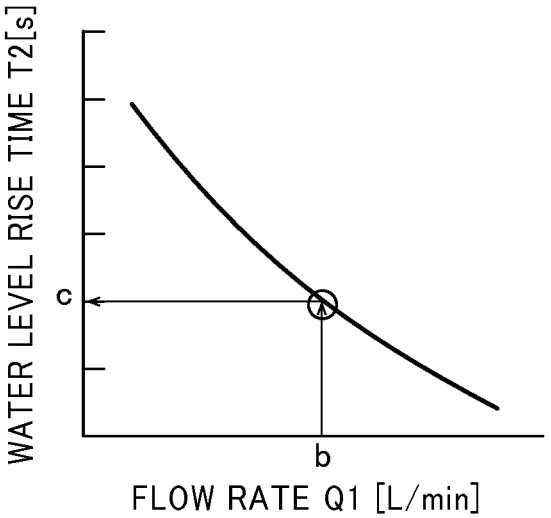
FIG. 5 is a characteristic diagram (relational diagram between water supply apparatus first water supply flow rate Q1 and reservoir tank water level rise time T2) for calculating the water level rise time T2 for the rise time from dead water level DWL1 inside the reservoir tank with the water discharge apparatus in a closed valve state to an initial water level (stopped water level WL) prior to start of flush from first water supply flow rate Q1, after the water supply apparatus is driven for a predetermined time to discharge water, when a flush toilet reservoir tank, water supply apparatus, and water discharge apparatus are applied to a reference toilet according to a first embodiment of the invention.

FIG. 5 is a characteristic diagram (relational diagram between water supply apparatus first water supply flow rate Q1 and reservoir tank water level rise time T2) for calculating the water level rise time T2 for the rise time from dead water level DWL1 inside the reservoir tank with the water discharge apparatus in a closed valve state, to an initial water level (stopped water level WL) prior to start of flush, from first water supply flow rate Q1, after the water supply apparatus is driven for a predetermined time to discharge water, when a flush toilet reservoir tank, water supply apparatus, and water discharge apparatus are applied to a reference toilet according to a first embodiment of the invention.

Figure 6:
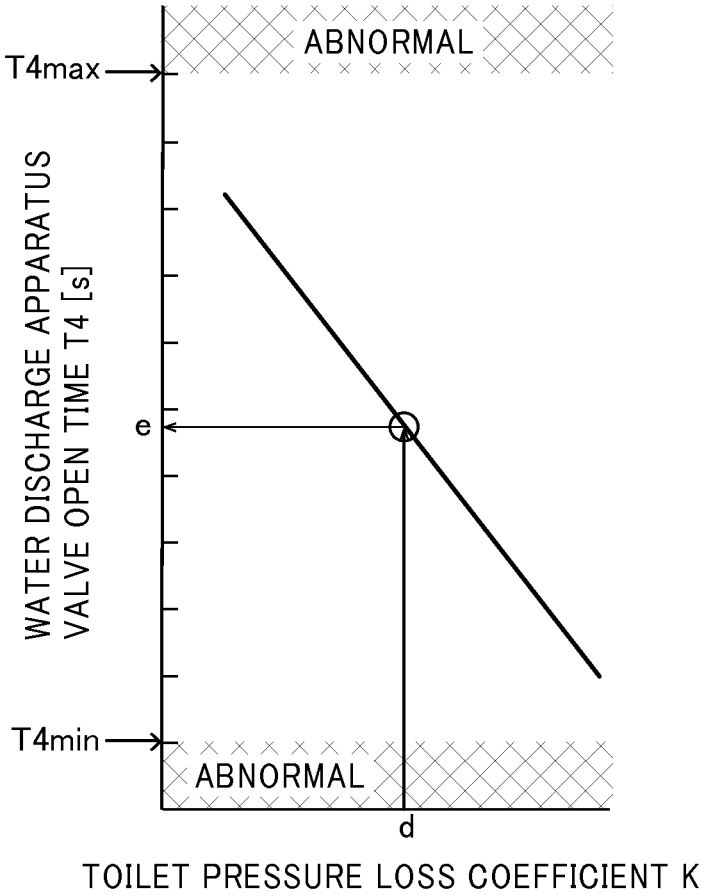
FIG. 6 is a characteristic diagram (relational diagram between toilet pressure loss coefficient K and water discharge apparatus valve opening time T4) for calculating water discharge apparatus valve opening time T4 based on toilet pressure loss coefficient K calculated from the ratio (T3/T2) between water level rise time T3, from dead water level DWL 1 inside the reservoir tank with the water discharge apparatus in a closed valve state after driving the water discharge apparatus for a predetermined time to discharge water, until rising to an initial water level (stopped water level WL), and the water level rise time T2 calculated in FIG. 5.

FIG. 6 is a characteristic diagram (relational diagram between toilet pressure loss coefficient K and water discharge apparatus valve opening time T4) for calculating water discharge apparatus valve opening time T4 based on toilet pressure loss coefficient K calculated from the ratio (T3/T2) between the water level rise time T3 from dead water level DWL 1 inside the reservoir tank, with the water discharge apparatus in a closed valve state after the water discharge apparatus is driven for a predetermined time to discharge water, up until rising to an initial water level (stopped water level WL), and the water level rise time T2 calculated in FIG. 5.

Note that as advance preparation, when the reservoir tank 4, water supply apparatus 20, and discharge apparatus 22 of the flush toilet 1 according to the embodiment are applied to the reference toilet, the flush toilet 1 first water supply flow rate Q1 (=b [L/min]) calculated in FIG. 4 is applied to the relational diagram between the water supply apparatus 20 first water supply flow rate Q1 experimentally obtained in advance, shown in FIG. 5, and the reservoir tank 4 water level rise time T2. Thus after discharge apparatus 22 is driven for a predetermined time and flush water is discharged, the water level rise time T2 (=c [s]) from the dead water level DWL1 inside reservoir tank 4, when discharge apparatus 22 has closed the valve, until rising to the initial stopped water level WL prior to start of flush, is pre-calculated.

In step S3 after time t5 in FIG. 3, when water supply valve 30 is closed immediately prior to time t6 and water supply valve 30 is again opened at time t6, discharge apparatus 22 again opens discharge port 18 for a provisional valve opening time. The water level inside reservoir tank 4 then drops, and float switch 24 turns off at time t7 in FIG. 3. When discharge apparatus 22 closes discharge port 18 at time t8 in FIG. 3, dead water level DWL1 inside reservoir tank 4 is determined, and a flush water amount corresponding to the difference between stopped water level WL and dead water level DWL1 inside reservoir tank 4, i.e. the flush water amount discharged to water passageway 8 in toilet main unit 2 from reservoir tank 4, is calculated. At the same time, control device 26 time measurement device 48 measures the water level rise time T3 (=t9−t8) from the dead water level DWL1 at time t8 inside reservoir tank 4 until the initial water level (stopped water level WL) prior to start of flush (see FIG. 1, T3).

In the present embodiment, a measurement is being made of the water level rise time T3 (=t9−t8) from time t8 when the water level inside reservoir tank 4 starts to rise up to the initial water level (stopped water level WL) t9 before start of flush, but it is also acceptable to measure the time for the water level to rise up to a predetermined water level below the initial water level or a predetermined water level above the initial water level, rather than to the initial water level itself.

Next, control device 26 calculates, as toilet pressure loss coefficient K, the ratio (T3/T2) between the water level rise time T3 for flush toilet 1 of the embodiment, measured by time measurement device 48, and the water level rise time T2 for a reference toilet calculated in FIG. 5, and completes step S3 in FIG. 3.

Here, if we consider that the flush toilet 1 and the reference toilet have the same reservoir tank 4 capacity and first water supply flow rate Q1, it can be confirmed that in cases where the toilet pressure loss coefficient K is greater than 1, flush toilet 1 water level rise time T3 is larger than reference toilet water level rise time T2, therefore flush toilet 1 has a lower dead water level DWL than the reference toilet, and the amount of flush water discharged from reservoir tank 4 to toilet main unit 2 increases, so flush toilet 1 pressure losses are smaller by that amount than reference toilet pressure losses.

On the other hand, if the toilet pressure loss coefficient K is 1, it can be confirmed that pressure losses are the same for flush toilet 1 and the reference toilet; when toilet pressure loss coefficient K is less than 1, it can be confirmed that flush toilet 1 pressure losses are greater than reference toilet pressure losses.

Next, the calculated toilet pressure loss coefficient K is applied to the relational diagram between the toilet pressure loss coefficient K experimentally determined in advance and shown in FIG. 6, and the water discharge apparatus valve opening time T4, and valve opening time T4 for discharge apparatus 22 is thereby calculated. Note that if we assume the toilet pressure loss coefficient K is a constant d, then discharge apparatus 22 valve opening time T4 is calculated from FIG. 6 to be e [s]; this calculated data is stored, and step S3 in FIG. 3 is completed.

Next, in step S4 following step S3 in FIG. 3, water supply valve 30 is closed for a predetermined time immediately prior to time t10, and at time t10 water supply valve 30 is again opened. Then a second water supply flow rate Q2, supplied to reservoir tank 4 from water supply apparatus 20 water supply port 32, is calculated in a similar step to that described above for step S2. Specifically, at time t10 in FIG. 3, discharge apparatus 22 is driven to release discharge port 18, the water level in reservoir tank 4 drops, and float switch 24 turns off at time t11 in FIG. 3.

Although the supply of water by water supply apparatus 20 is continuing, the speed at which the water level inside reservoir tank 4 drops greatly exceeds the speed at which the water level rises by supplying water, therefore the water level inside reservoir tank 4 goes to an empty state (DWL2=0) (see DWL2 in FIG. 1). Thereafter, at time t12 in FIG. 3, discharge apparatus 22 again closes discharge port 18 with the water level inside reservoir tank 4 in an empty state (DWL2=0), while simultaneously the time measurement device 48 in control device 26 measures water level rise time T5 (=t13 −t12 ) from the water level inside reservoir tank 4 at time t12 until rising to the initial water level (stopped water level WL) prior to start of flush (see T5 in FIGS. 1 and 3). At time t13 in FIG. 3, float switch 24 goes from off to on, water supply valve 30 is closed, and the supply of water by water supply apparatus 20 is stopped.

Then, second water supply flow rate Q2 is calculated by applying water level rise time T5, measured by time measurement device 48 from time t12 until time t13 in FIG. 3, to the relational diagram between the reservoir tank water level rise time T1 experimentally obtained in advance and shown in FIG. 4, and water supply apparatus 20 first water supply flow rate Q1. This second water supply flow rate Q2 is then compared to first water supply flow rate Q1, calculated and stored in step S2 of FIG. 3, and when the difference between the two is within a predetermined range, the system advances to step S5. In step S5 of FIG. 3, the discharge apparatus 22 valve opening time T4, calculated and stored in step S3 of FIG. 3, is fixed, and step S5 is completed.

On the other hand, when the difference between the second water supply flow rate Q2 calculated in step S4 of FIG. 3 and the first water supply flow rate Q1 calculated and stored in step S2 of FIG. 3 is outside a predetermined range, step S1 in FIG. 1 is again re-executed.

Next, in step S6 of FIG. 3, if the water level rise time T4 calculated in the previous step S5 is under the pre-determined minimum water level rise time T4min, or over the pre-determined maximum water level rise time T4max, then a determination is made that water level rise time T4 is an abnormal value, and one iteration only of re-measurement is performed. If the value is again determined to be abnormal, notification device 50 informs the user that an appropriate toilet pressure loss learning control has not been performed, and also sets a default value water supply flow rate Q0 with which flush capability can be secured in view of pressure losses of toilet main unit 2. A re-execution is again performed starting from step S2 in FIG. 3, and the discharge apparatus 22 valve opening time T4 is determined in the subsequently re-executed step S5 in FIG. 3.

On the other hand, when water level rise time T4 is within the range between minimum water level rise time T4min and maximum water level rise time T4max, it is determined to be a normal value, and the system advances to step S7 in FIG. 3, completing the setting, after which a true toilet flush operation becomes possible, and flush toilet 1 becomes substantially usable.

In a flush toilet 1 according to the above-described first embodiment of invention, in order to adjust the driving of water discharge apparatus 22 responsive to pressure losses in toilet main unit 2, flush control device 26 measures the rise time for the water level inside the reservoir tank with water discharge apparatus 22 in an off state until it rises to a predetermined water level, hence a longer measurement time can be secured compared to the conventional art in which the water level drop time for the water level to drop from a predetermined initial water level inside the reservoir tank prior to start of flush, to a water level with water discharge apparatus 22 in an off state, therefore a measurement can be made of the water level inside a stable reservoir tank with no waves on the water surface. Therefore pressure losses in subject toilet main unit 2 (e.g., water passageway pressure losses) can be accurately detected, and an appropriate adjustment of the driving of water discharge apparatus 22 can be made according to pressure losses in each toilet main unit. Since driving of water discharge apparatus 22 can be appropriately adjusted by the flush control device in response to pressure losses in each toilet main unit 2 even if manufacturing errors have occurred in the subject toilet main unit 2, toilets can be reliably flushed without loss of flushing performance. Moreover, wasted flush water can be decreased and water conserved.

In flush toilet 1 according to the above-described first embodiment of the invention, in order to adjust the driving time of discharge apparatus 22 responsive to pressure losses in toilet main unit 2, time measurement device 48 measures a first water level rise time from the water level inside a reservoir tank with discharge apparatus 22 in an off state until rising to a predetermined initial water level prior to start of flush, therefore compared to the case where time measurement device 48 measures the water level drop time for the water level to drop from a predetermined initial water level prior to flush start inside the reservoir tank, down to the water level when discharge apparatus 22 is in an off state, this is a simpler configuration with which a longer measurement time can be secured. Therefore water discharge apparatus 22 driving time can be more precisely adjusted in response to pressure losses in toilet main unit 2. Also, because the driving time of water discharge apparatus 22 can be more precisely adjusted by the flush control device in response to pressure losses in each toilet main unit 2 even if manufacturing errors have occurred in the subject toilet main unit 2, toilets can be more reliably flushed without loss of flushing performance. Moreover, wasted flush water can be decreased and water conserved.

In the flush toilet 1 according to the above-described first embodiment of the invention, because time measurement device 48 measures water level rise time T3 for the rise from the dead water level DWL1 inside reservoir tank 4 with discharge port 18 closed by discharge apparatus 22, up to a predetermined initial water level (stopped water level WL) prior to start of flush, in order to adjust valve opening time T4 on discharge apparatus 22 in response to pressure losses in toilet main unit 2, a longer measurement time can be secured compared to the case in which time measurement device 48 measures the water level drop time for dropping from a predetermined initial water level (stopped water level WL) prior to flush start until reaching dead water level DWL1. Therefore by comparing the water level rise time T3 measured by time measurement device 48 with the water level rise time T2 in a standard toilet, toilet pressure loss coefficient K can be derived and pressure losses in the subject toilet main unit 2 (e.g., pressure loss in water passageway 8) can be precisely detected, so the valve opening time T4 of discharge apparatus 22 can be appropriately adjusted in response to pressure losses in each toilet main unit 2. Since the valve opening time T4 of water discharge apparatus 22 can be appropriately adjusted by control device 26 in response to pressure losses in each toilet main unit 2 even if manufacturing errors have occurred in the subject toilet main unit 2, toilets can be reliably flushed without loss of flushing performance. Moreover, wasted flush water can be decreased and water conserved.

Also, using flush toilet 1 of the present embodiment, the water discharge apparatus is run for a predetermined time to empty the reservoir tank (DWL2=0), following which time measurement device 48 measures water level rise time T1, from the state in which discharge apparatus 22 closes discharge port 18, until the water level inside reservoir tank 4 rises to a predetermined initial water level (stopped water level WL), enabling the determination of water level rise time T2 in a standard toilet from either first water supply flow rate Q1 calculated from this water level rise time T1 and the capacity of reservoir tank 4, or first water supply flow rate Q1 calculated from the relationship between water level rise time T1 and FIG. 4. Toilet pressure loss coefficient K can be calculated from the ratio (T3/T2) between water level rise time T3 and water level rise time T2 by comparing water level rise time T3 in flush toilet 1 and water level rise time T1 in a standard toilet, and the discharge apparatus 22 valve opening time T4 can be calculated from FIG. 6 based on this toilet pressure loss coefficient K. Therefore discharge apparatus 22 valve opening time T4 responsive to pressure losses in toilet main unit 2 can be precisely adjusted, and even if manufacturing errors in the subject toilet main unit 2 arise, discharge apparatus 22 valve opening time T4 can be more precisely adjusted by control device 26 in response to pressure losses in each toilet main unit 2. As a result of the above, more reliable toilet flushing can be performed without loss of toilet flushing performance, and wasted flush water can be decreased and water conserved.

Moreover, using the flush toilet 1 of the present embodiment, when measurements of water level rise time T1 and water level rise time T2 are respectively continuously performed by time measurement device 48 in steps S2 to S3 shown in FIGS. 2 and 3, placing water supply apparatus 20 in an off state before the respective measurements and subsequently activating water supply apparatus 20 and starting the supply of flush water into reservoir tank 4 stabilizes the behavior of fixed flow rate valve 34 and suppresses flow rate variability, so that fluctuations of first water supply flow rate Q1 into reservoir tank 4 by water supply apparatus 20 can be prevented, and the rise of the water level inside reservoir tank 4 stabilized. Therefore the water level rise times T1 and T3 can be respectively precisely measured, and water discharge apparatus 22 valve opening time T4 responsive to pressure losses in toilet main unit 2 can be more precisely adjusted. Also, because the driving time T4 of water discharge apparatus 22 can be more precisely adjusted by control device 26 in response to pressure losses in each toilet main unit 2 even if manufacturing errors have occurred in the subject toilet main unit 2, toilets can be more reliably flushed without loss of flushing performance. Moreover, wasted flush water can be decreased and water conserved.

In a flush toilet 1 according to the present embodiment, even if, after calculating the first water supply flow rate Q1 in step S2 of FIG. 3, there are fluctuations in the water supply flow rate up until the second water supply flow rate Q2 is calculated in step S4 of FIG. 3, and the second water supply flow rate Q2 differs greatly from the first water supply flow rate Q1, a setting can be made to a specified value water supply flow rate Q0 at which sufficient flushing capability can be secured in view of pressure losses in the toilet main unit 2, therefore a valve opening time T4 for water discharge apparatus 22 can be determined. Therefore water discharge apparatus 22 valve opening time T4 can be adjusted in response to pressure losses in toilet main unit 2. Since the valve opening time T4 of water discharge apparatus 22 can be adjusted by control device 26 in response to pressure losses in each toilet main unit 2 even if manufacturing errors have occurred in the subject toilet main unit 2, toilets can be more reliably flushed without loss of flushing performance. Moreover, wasted flush water can be decreased and water conserved.

Furthermore, in the flush toilet 1 according to the present embodiment the fact that an appropriate toilet pressure loss learning control has not been carried out can be informed to a user by notification device 50, and a flush toilet operates on which a pre-set value water supply flow rate Q0, capable of securing sufficient flushing capability in view of pressure losses in toilet main unit 2, has been set, so that a reliable toilet flush can be implemented.

In the flush toilet 1 according to the above-described first embodiment of the invention we explained an example of implementing toilet pressure loss learning control using a series of steps from step S0 through S7 in FIG. 3, but in cases where a stable flow rate is assured at all times, without variation in the flow rate supplied to reservoir tank 4 by water supply apparatus 20, it is acceptable to respectively omit the step S2 step for confirming first water supply flow rate Q1 and the step S4 step for confirming second water supply flow rate Q2.

Next, referring to FIGS. 7-11, we explain a flush toilet according to a second embodiment of the invention.

Here, in the flush toilet according to the second embodiment of the invention shown in FIGS. 7-11, the same reference numerals are assigned to those parts which are the same as those of the flush toilet according to the first embodiment of the invention described above, and an explanation thereof is omitted.

Figure 7:
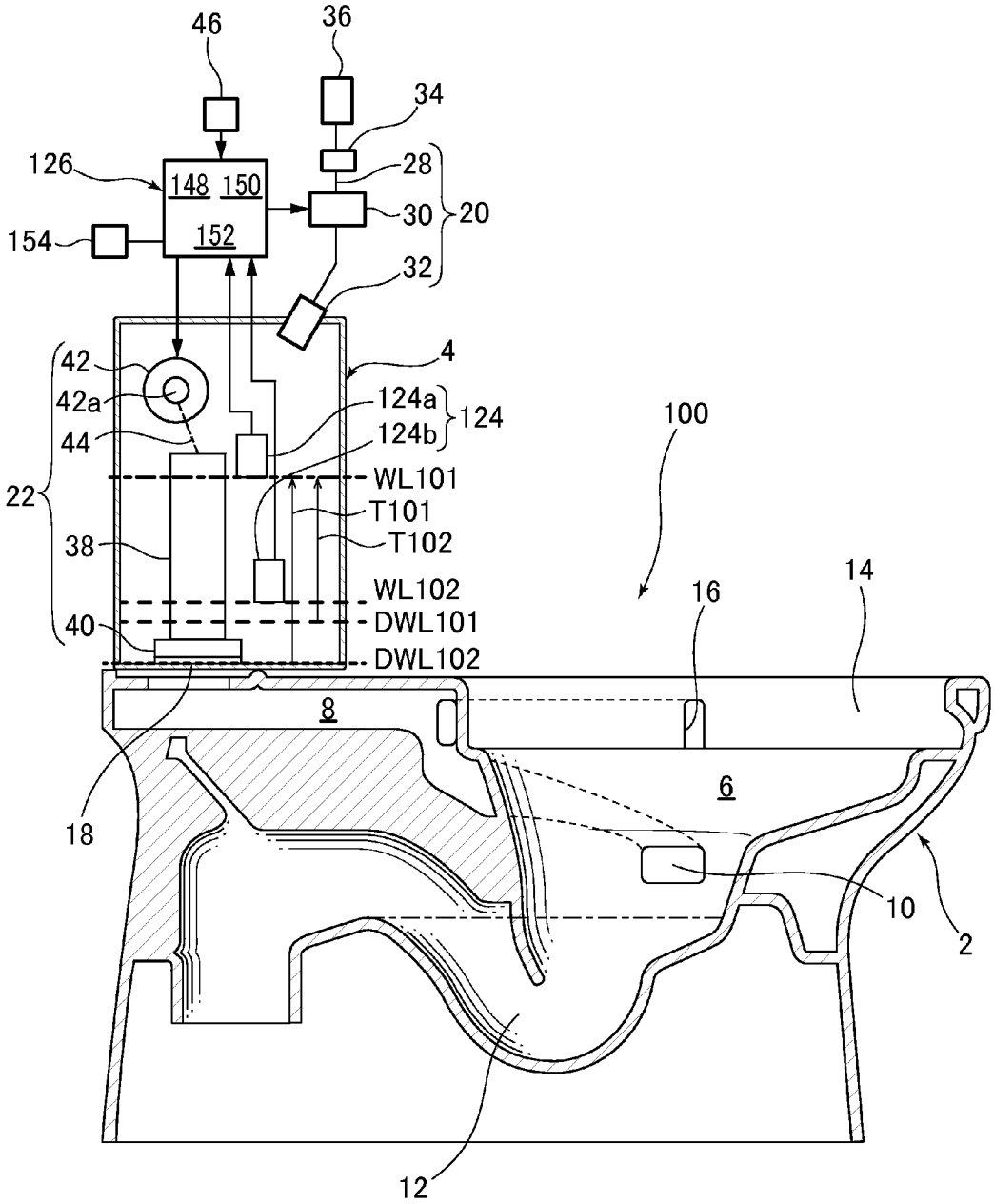
FIG. 7 is a schematic diagram of a flush toilet according to a second embodiment of the present invention.

First, FIG. 7 is a summary diagram of a flush toilet according to a second embodiment of the present invention.

As shown in FIG. 7, flush toilet 100 according to a second embodiment of the invention is a wash-down type of flush toilet, like flush toilet 1 according to the first embodiment of the invention.

As shown in FIG. 7, flush toilet 100 of the embodiment has a control device 126 comprising a float switch 124, described in detail below, being a water level sensor for sensing the water level inside reservoir tank 4; this control device 126 controls the operation of water supply apparatus 20 and discharge apparatus 22 based on water level information sensed by float switch 124, and functions as a flush control device for controlling the flushing of bowl portion 6 by supplying flush water stored inside reservoir tank 4 through water passageway 8 to spout ports 10, 16.

Here, as shown in FIG. 7, the level of flush water remaining in reservoir tank 4, when discharge port 18 is opened and valve member 40 closes discharge port 18 with the water level inside valve member 40 in a dropped state, is dead water level DWL101.

In a normal flushing operation of flush toilet 1, when the water level inside reservoir tank 4 rises from the dead water level DWL101 state to stopped water level WL101 at which the water level in the reservoir tank contacts float switch 24 due to the supply of water by water supply apparatus 20, the supply of water by water supply apparatus 20 is stopped.

Note that water level DWL102 inside reservoir tank 4 in FIG. 7 shows the water level with reservoir tank 4 in an empty state (DWL102=0), and dead water level DWL101 is a higher water level than the empty water level DWL102.

Control device 126 comprises a water supply flow rate measurement device 150 for measuring the supply flow rate Q101 of flush water supplied from water supply apparatus 20 to reservoir tank 4 while the water level inside reservoir tank 4 is rising; this water supply flow rate measurement device 150 comprises an upper float switch 124*a* and a lower float switch 124*b*, which is a lower water level sensor disposed below upper float switch 124*a*.

Upper float switch 124*a* is positioned at the same position as stopped water level WL101 inside reservoir tank 4, and is able to sense stopped water level WL101 inside reservoir tank 4 when the supply of water by water supply apparatus 20 stops.

Lower float switch 124*b* is positioned at the same position as predetermined water level WL102, above dead water level DWL101 and below stopped water level WL101, and is able to sense predetermined water level WL102.

Note that in this embodiment we employed a float switch as an example of a water level sensor for detecting the water level inside reservoir tank 4, but a water level sensor of a form other than a float switch may also be employed.

Also, control device 126 comprises an adjustment apparatus 152 for adjusting the driving time of discharge apparatus 22 responsive to pressure losses in toilet main unit 2 according to the water level rise time measured by time measurement device 148 and the water level flow rate measured based on information about the water level inside reservoir tank 4 sensed by upper float switch 124*a* and lower float switch 124*b*. After a flush toilet 1 has been installed at an individual installation site and before substantive use of the toilet begins, the driving time of rotary drive apparatus 42 on discharge apparatus 22 and the valve opening time on valve member 40 can be appropriately adjusted in response to pressure losses in toilet main unit 2 for each flush toilet 1 (in particular, pressure losses in water passageway 8, etc.).

Moreover, control device 126 comprises a notification device 154 for informing users of the abnormal state that appropriate toilet pressure loss learning control has not been carried out, by flashing an LED display or the like.

Next, referring to FIGS. 7 through 11, we explain the content of toilet pressure loss learning control by a flush toilet control device according to a second embodiment of the present embodiment.

Figure 8:
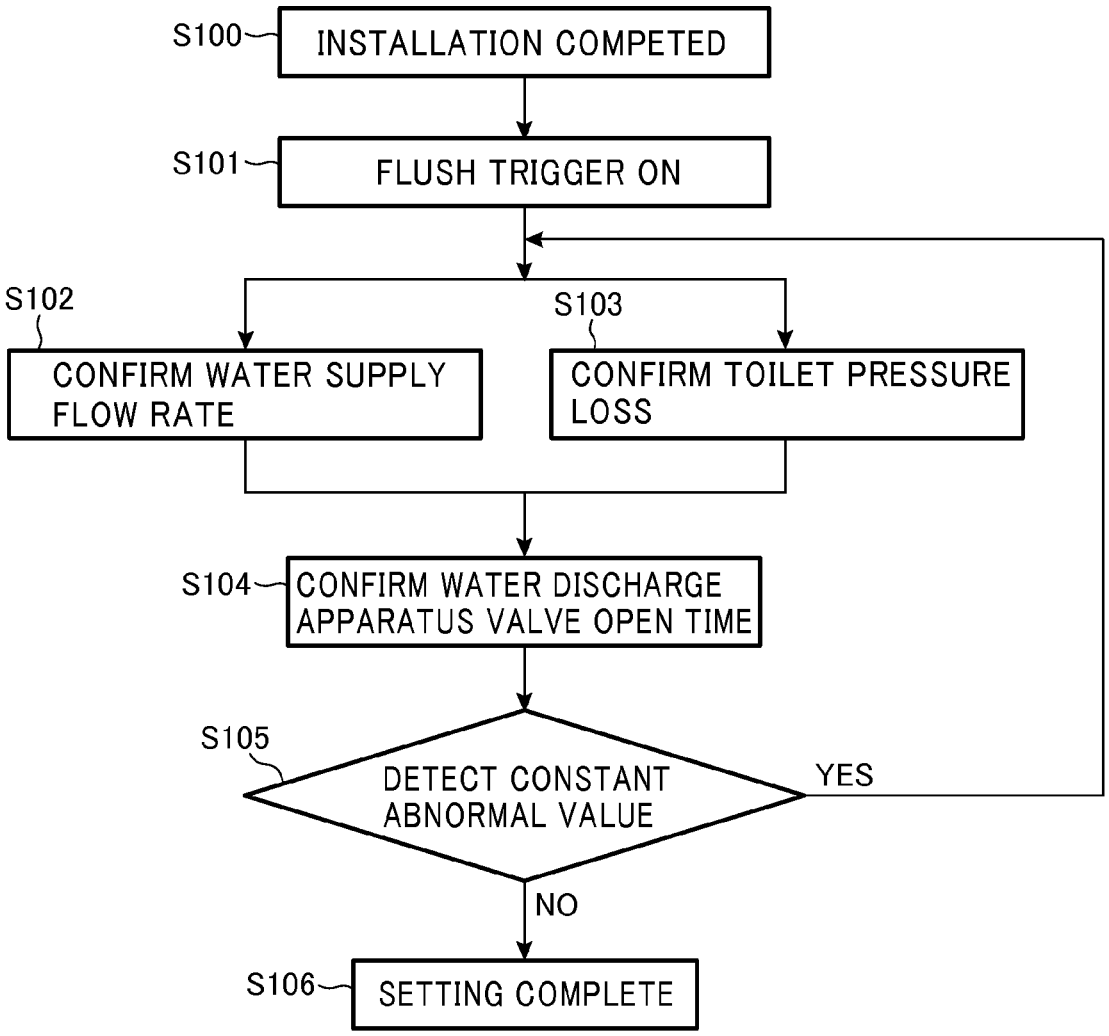
FIG. 8 is a flow chart showing the content of toilet pressure loss learning control using a flush toilet control apparatus according to a second embodiment of the present invention.
Figure 9:
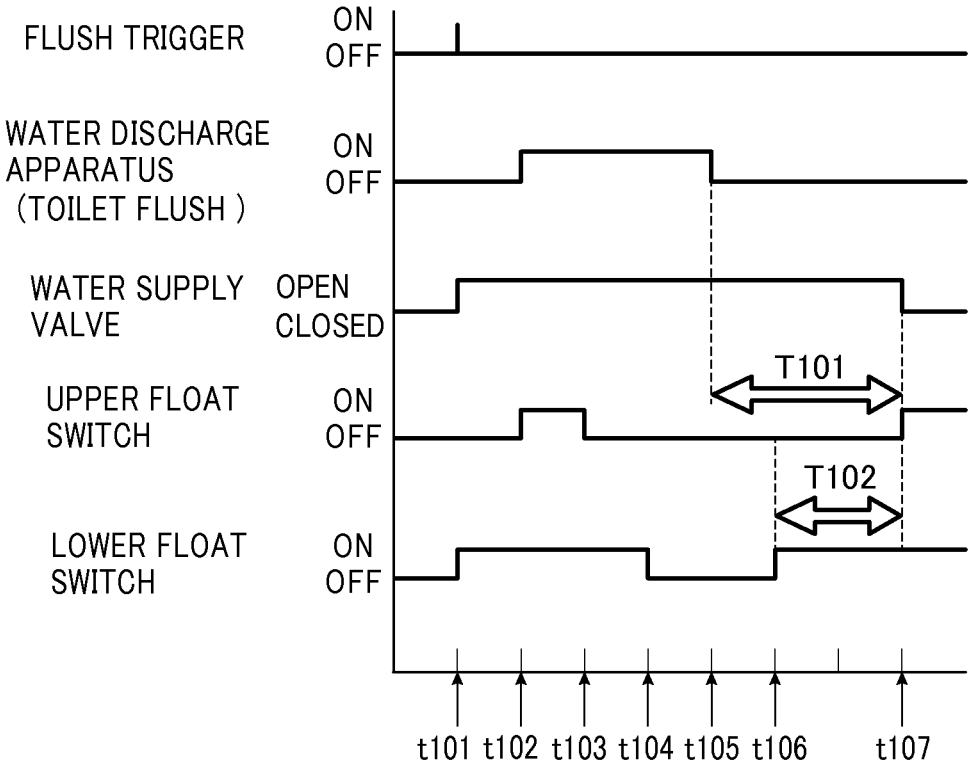
FIG. 9 is a timing chart showing the operation of a flush toilet according to a second embodiment of the present invention.

FIG. 8 is a flow chart showing the content of toilet pressure loss learning control using a flush toilet control apparatus according to a second embodiment of the present invention; FIG. 9 is a timing chart showing the operation of a flush toilet according to a second embodiment of the present invention.

As shown in FIGS. 8 and 9, a flush toilet 100 per the present embodiment is first installed at a predetermined installation site in FIG. 8, step S101, and when installation is completed a flush test is performed in FIG. 8, step S101. In the flush test, a flush trigger is turned on at FIG. 9 time t101 regardless of which of the flush mode switch buttons (not shown) is pushed among the large flush mode, small flush mode, and eco small flush mode on operating button 46.

At time t101 in FIG. 9, water supply valve 30 opens, after which water is supplied into reservoir tank 4 by water supply apparatus 20 until time t107 in FIG. 9.

Furthermore, at time t101 in FIG. 9, the water level in reservoir tank 4 is positioned at predetermined water level WL102 between dead water level DWL101 and stopped water level WL101, or at a water level above predetermined water level WL102 and above stopped water level WL101, so upper float switch 124*a* is off, but lower float switch 124*b* is on.

Next, at time t102 in FIG. 9, the water level in reservoir tank 4 rises to stopped water level WL101, and upper float switch 124*b* turns on. Then discharge apparatus 22 is driven and opens discharge port 18, while at the same time toilet flushing is started; thereafter from time t102 until time t105 in FIG. 9, overflow pipe 38 and valve member 40 of discharge apparatus 22 are held for a predetermined time (a provisional valve opening time), pulled up to a certain height, and discharge port 18 is released for a predetermined time (a provisional valve opening time). Then flush water inside reservoir tank 4 is supplied to water passageway 8 in toilet main unit 2 and directed to the spout port 10 or rim spout port 16 on bowl portion 6.

Next, after time t102 in FIG. 9, the water level inside reservoir tank 4 drops when upper float switch 124*a* turns off at time t103 in FIG. 9, and when the water level inside reservoir tank 4 drops to a level lower than predetermined water level WL102 and higher than dead water level DWL101 at time t104 in FIG. 9, lower float switch 124*b* turns off.

Next, after time t104 in FIG. 9, when the water level in reservoir tank 4 drops and time t105 in FIG. 9 is reached, discharge apparatus 22 closes discharge port 18. The water inside reservoir tank 4 at time t103 in FIG. 9 is at dead water level DWL101, and until time t107 when the supply of water by water supply apparatus 20 is continued, the water level inside reservoir tank 4 rises due to the supply of water by water supply apparatus 20.

Therefore lower float switch 124*b* turns on when the water level in reservoir tank 4 rises to predetermined water level WL102 at time t106 in FIG. 9, and upper float switch 124*a* again turns on when the water level inside reservoir tank 4 further rises to stopped water level WL101 at time t107 in FIG. 9.

Between times t105 and t107 in FIG. 9, the time measurement device 148 in control device 126 measures the time T101 (=t107−t105) for the water level to rise from the dead water level DWL101 in reservoir tank 4 to stopped water level WL101, and between time t106 and t107 in FIG. 9, the time measurement device 148 in control device 126 measures the time T102 (=t107−t106) for the water level to rise from predetermined water level WL102 in reservoir tank 4 to stopped water level WL101, and steps S102 and S103 in FIG. 8 are executed in parallel.

Next, referring to FIGS. 7-10, we explain the concrete content of steps S102 and S103 in FIG. 8.

First, in step S102 of FIG. 8, the water supply flow rate Q101 supplied to reservoir tank 4 from water supply port 32 on water supply apparatus 20 is calculated.

Below, referring to FIGS. 7-9, we specifically explain the method for calculating water supply flow rate Q101 in step S102 of FIG. 8.

As shown in FIGS. 7-9, in step S102 during the interval from time t106 to time t107 in FIG. 9, the time measurement device 148 in control device 126 measures the water level rise time for the water level inside reservoir tank 4 to rise from predetermined water level WL102 to stopped water level WL101, based on position information inside reservoir tank 4 sensed by upper float switch 124*a* and lower float switch 124*b*.

Also, because the positions of upper float switch 124*a* and lower float switch 124*b* inside reservoir tank 4 are respectively fixed, a water supply volume V101 [l] is also determined, equal to the capacity inside reservoir tank 4, which corresponds to the water level to which water rises from time t106 in FIG. 9 when lower float switch 124*b* senses predetermined water level WL102 in reservoir tank 4, until time t107 in FIG. 8 when upper float switch 124*a* senses stopped water level WL101.

Therefore in step S102, time measurement device 148 measures the water level rise time T102 from time t106 in FIG. 9 when lower float switch 124*b* senses predetermined water level WL102 in reservoir tank 4 until time t107 in FIG. 8 when upper float switch 124*a* senses stopped water level WL101.

Using this water level rise time T102 and water level volume V101, water supply flow rate measurement device 150 then calculates the water supply flow rate Q101 [1/min] (=V101/T102) supplied into reservoir tank 4 by water supply apparatus 20. I.e., water supply flow rate Q101 is calculated from the water level volume V101 and the water level rise time T102, which starts at predetermined water level WL102 in reservoir tank 4 and goes to stopped water level WL101. When this calculated water supply flow rate Q101 data is stored, step S102 in FIG. 8 is completed.

Next, in step S103 of FIG. 8, pressure losses in flush toilet 100 are confirmed.

Below, referring to FIGS. 7-10, we explain specifically the method for confirming pressure losses in flush toilet 100.

Figure 10:
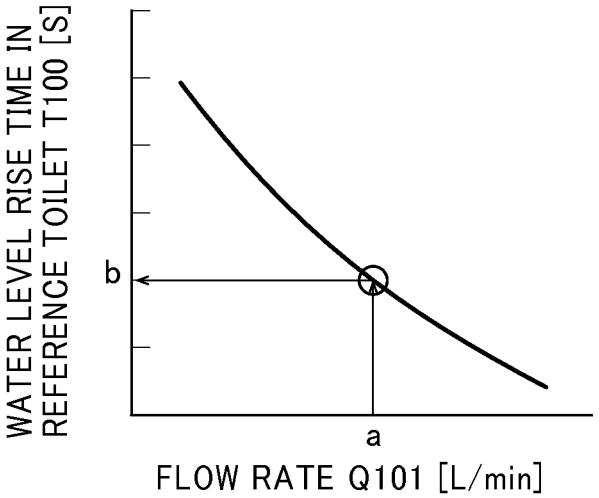
FIG. 10 is a characteristic diagram (relational diagram between water supply apparatus first water supply flow rate Q101 and reservoir tank water level rise time T100) for calculating the water level rise time T100 for the rise time from dead water level DWL101 inside the reservoir tank with the water discharge apparatus in a closed valve state, to an initial water level (stopped water level WL101) prior to start of flush from first water supply flow rate Q101, after the water supply apparatus is driven for a predetermined time to discharge water, when a flush toilet reservoir tank, water supply apparatus, and water discharge apparatus according to a second embodiment of the invention are applied to a reference toilet.

FIG. 10 is a characteristic diagram (relational diagram between water supply apparatus first water supply flow rate Q101 and reservoir tank water level rise time T100) for calculating the water level rise time T100 for the rise time from dead water level DWL101 inside the reservoir tank with the water discharge apparatus in a closed valve state, to an initial water level (stopped water level WL101) prior to start of flush from first water supply flow rate Q101, after the water supply apparatus is driven for a predetermined time to discharge water, when a flush toilet reservoir tank, water supply apparatus, and water discharge apparatus according to a second embodiment of the invention are applied to a reference toilet.

First, in step S103 of FIG. 8, adjustment apparatus 152 applies the water supply flow rate Q101 calculated in step S102 of FIG. 8 (=a [L/min]) to the relational diagram between the water flow rate Q101 supplied by water supply apparatus, 20 determined experimentally in advance and shown in FIG. 10, and the water level rise time T100 in reservoir tank 4. Thus in the reference toilet after discharge apparatus 22 is driven for a predetermined time and flush water is discharged, a calculation is made of the water level rise time T100 (=b [s]) from the dead water level DWL101 inside reservoir tank 4, when discharge apparatus 22 has closed the valve, until rising to the initial stopped water level WL101 prior to start of flush.

Next, adjustment apparatus 152 calculates, as toilet pressure loss coefficient K, the ratio (T101/T100) between water level rise time T101 in the flush toilet 100 of the present embodiment, measured by the time measurement device 148 in control device 126 from time t105 to time t107 in FIG. 9, and water level rise time T100 of a reference toilet calculated using FIG. 10.

It was confirmed that when toilet pressure loss coefficient K is greater than 1, the flush toilet 100 water level rise time T101 exceeds water level rise time T100, therefore dead water level DWL101 is lower in flush toilet 100 than in the reference toilet, and the volume of flush water discharged to toilet main unit 2 from reservoir tank 4 increases, such that pressure losses in flush toilet 100 are smaller by that amount than pressure losses in the reference toilet.

On the other hand if toilet pressure loss coefficient K is 1, it can be confirmed that pressure losses are the same for flush toilet 100 and the reference toilet, and when toilet pressure loss coefficient K is less than 1, it can be confirmed that flush toilet 100 pressure losses are greater than reference toilet pressure losses.

The calculated toilet pressure loss coefficient K is then stored, and step S103 of FIG. 8 is completed.

Figure 11:
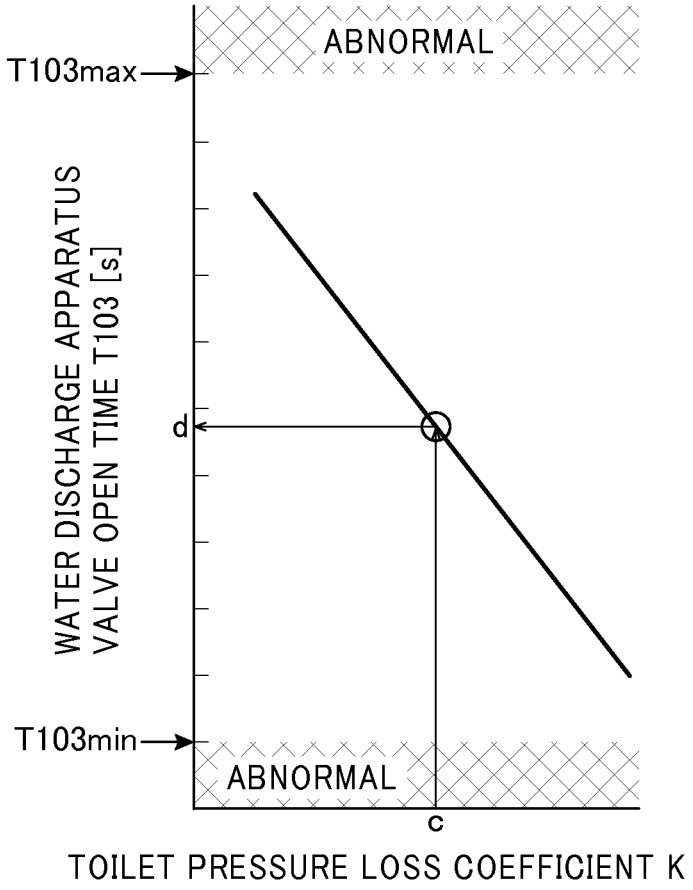
FIG. 11 is a characteristic diagram, in toilet pressure loss sensing control by a flush control device using a flush toilet according to a second embodiment of the invention, which corresponds to a characteristic diagram (relational diagram between toilet pressure loss coefficient K and discharge apparatus valve opening time T103) for calculating discharge apparatus valve opening time T103 based on toilet pressure loss coefficient K, which is calculated from the ratio (T101/T100) between water level rise time T101, being the time for the water level to rise from dead water level DWL1 inside the reservoir tank, with the water discharge apparatus in a closed state after the water discharge apparatus is driven for a predetermined time to discharge flush water, up to an initial water level prior to start of flush (stopped water level WL101) and, in a reference toilet, water level rise time T100, being the time, after the water discharge apparatus is driven a predetermined time to discharge flush water to dead water level DWL101, for the water level to rise from dead water level DWL101 to stopped water level WL101.

Next, in toilet pressure loss sensing control by a flush control device using a flush toilet according to a second embodiment of the invention, FIG. 11 a characteristic diagram (relational diagram between toilet pressure loss coefficient K and discharge apparatus valve opening time T103) for calculating discharge apparatus valve opening time T103 based on toilet pressure loss coefficient K, which is calculated from the ratio (T101/T100) between water level rise time T101, being the time for the water level to rise from dead water level DWL1 inside the reservoir tank, with the water discharge apparatus in a closed state after the water discharge apparatus is driven for a predetermined time to discharge flush water, up to an initial water level prior to start of flush (stopped water level WL101) and, in a reference toilet, water level rise time T100, being the time, after the water discharge apparatus is driven a predetermined time to discharge flush water to dead water level DWL101, for the water level to rise from dead water level DWL101 to stopped water level WL101.

In step S104 of FIG. 8, adjustment apparatus 152 applies the calculated toilet pressure loss coefficient K to the relational diagram between the experimentally defined toilet pressure loss coefficient K shown in FIG. 11 and the water discharge apparatus valve opening time T103, and calculates and fixes discharge apparatus 22 valve opening time T103. It happens that if we assume that toilet pressure loss coefficient K is a constant c, then discharge apparatus 22 valve opening time T103 is calculated as e [s] from FIG. 11; this calculated data is stored, and step S104 in FIG. 8 is completed.

Fixing discharge apparatus 22 valve opening time T103 in step S104 of FIG. 8 then also fixes the dead water level DWL101 inside reservoir tank 4.

Next, in step S105 of FIG. 8, if the water level rise time T103 calculated in the previous step S104 is under the pre-determined minimum water level rise time T103min, or over the pre-determined maximum water level rise time T103max, then a determination is made that water level rise time T103 is an abnormal value, and one iteration only of re-measurement is performed.

Also, if the value is again determined to be abnormal in step S105 of FIG. 8, notification device 154 informs the user that an appropriate toilet pressure loss learning control has not been performed, and also sets a default value water supply flow rate Q100 with which flush capability can be secured in view of the pressure losses in toilet main unit 2. Steps S102, S103 in FIG. 8 are then again re-executed, and discharge apparatus 22 valve opening time T103 is fixed in the subsequently re-executed step S104 in FIG. 8.

Meanwhile in step S105 of FIG. 8, when water level rise time T103 is within the range between minimum water level rise time T103min and maximum water level rise time T103max, the value is determined to be normal, the discharge apparatus 22 valve opening time T103 calculated in step S104 of FIG. 8 is fixed, and the system advances to step S106, completing the settings.

After the completion of settings in step S106 of FIG. 8, a substantive toilet flushing operation becomes possible, and flush toilet 100 is placed in a substantially usable state.

Using flush toilet 100 according to the above-described second embodiment of the invention, while the time T101 for water to rise from dead water level DWL101 with discharge apparatus 22 in a stopped state to stopped water level WL101 is being measured by time measurement device 148 of control device 126, water supply flow rate measurement apparatus 150 is measuring the water supply flow rate Q101 being supplied to storage tank 4 based on water level information sensed by float switches 124*a* and 124*b*, therefore with respect, for example, to the water supply flow rate from the water source to storage tank 4, compared to the case where the measurement is made from the measured time for water to accumulate in storage tank 4 after storage tank 4 is first emptied, together with a previously determined storage tank 4 capacity, this approach enables detection of pressure losses (toilet pressure loss coefficient K) in the subject toilet main unit 2 in a short time, and offers precise detection of accurate water supply flow rates without being affected by fluctuations in water supply pressure. A discharge apparatus 22 valve opening time T103 responsive to pressure losses (toilet pressure loss coefficient K) in each toilet main unit 2 can therefore be appropriately adjusted by adjustment apparatus 152, and the need to keep installers who are performing initial settings waiting for long periods during installation can be eliminated.

Also, using the flush toilet 100 according to a second embodiment of the invention, because the rising water level is sensed by upper float switch 124*a* and lower float switch 124*b* when measuring with time measurement device 148, and water supply flow rate measurement device 150 calculates water supply flow rate Q101, water supply flow rate Q101 can be measured in the same step in which water level rise time T102 is measured by time measurement device 148. Therefore compared to measurement using the measured time for water to accumulate in reservoir tank 4 from a temporarily empty reservoir tank 4 state and a predetermined reservoir tank 4 capacity, the subject toilet main unit 2 pressure losses (toilet pressure loss coefficient K) can be detected in a short period of time. Also, because pressure losses (toilet pressure loss coefficient K) for the subject toilet main unit 2 are measured by FIGS. 10 and 11 using the water supply flow rate Q101 when measuring by time measurement device 148, a precise detection can be made.

Furthermore, using the flush toilet 100 according to a second embodiment of the invention, lower float switch 124*b* can detect water level WL102 above the dead water level DWL101 in a reservoir tank 4 with discharge apparatus 22 in an off state, and below stopped water level WL102, water level rise time T102 can be accurately measured even when the dead water level DWL fluctuates inside reservoir tank 4 with discharge apparatus 22 in an off state. Therefore compared to measurement using the measured time for water to accumulate in reservoir tank 4 from a temporarily empty reservoir tank 4 state and a predetermined reservoir tank 4 capacity, the subject toilet main unit 2 pressure losses (toilet pressure loss coefficient K) can be detected in a short period of time, and an accurate water supply flow rate can be precisely detected without being influenced by fluctuations in water supply pressure.

Also, using the flush toilet 100 according to a second embodiment of the invention, after discharge apparatus 22 is driven and flush water is discharged, the water level detected by upper float switch 124*a* is positioned at the same position as the risen water level WL101 inside reservoir tank 4 with discharge apparatus 22 in an off state, therefore the measurement by time measurement device 148 and the measurement by water supply flow rate measurement device 150 upper float switch 124*a* can be simultaneously completed at time t107 in FIG. 9. Therefore compared to measurement using the measured time for water to accumulate in reservoir tank 4 from a temporarily empty reservoir tank 4 state and a predetermined reservoir tank 4 capacity, the subject toilet main unit 2 pressure losses (toilet pressure loss coefficient K) can be detected in a short period of time.

Also, using the flush toilet 100 according to a second embodiment of the invention, pressure losses (toilet pressure loss coefficient K) in the subject toilet main unit 2 can be more precisely detected by adjustment apparatus 152 comparing the water level rise time T101 measured by time measurement device 148 with the water level rise time T100 in a standard toilet, and adjustment apparatus 152 can appropriately adjust the discharge apparatus 22 driving time T103 responsive to pressure losses (toilet pressure loss coefficient K) in each toilet main unit 2.

Figure 12:
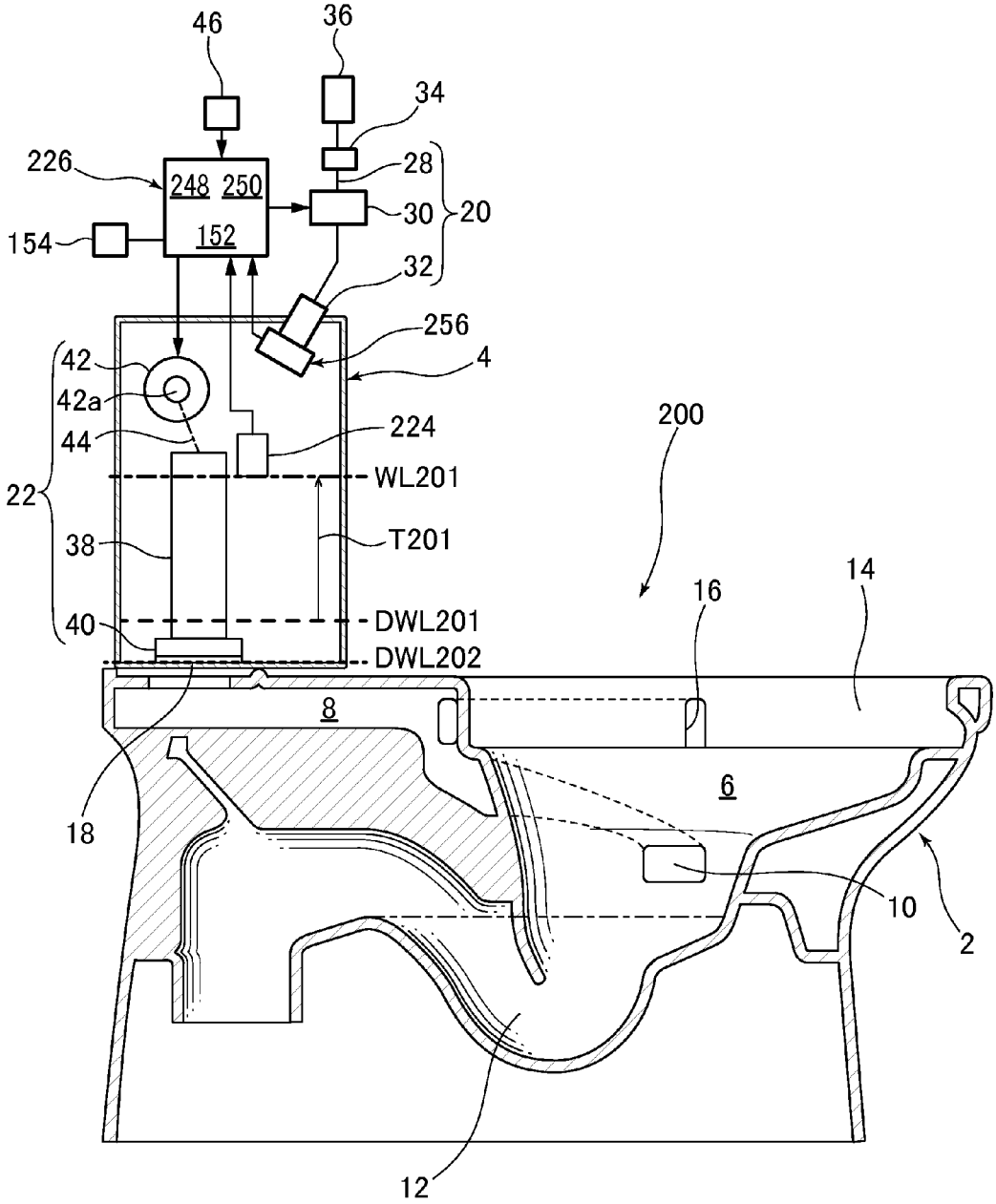
FIG. 12 is a summary diagram of a flush toilet according to a third embodiment of the present invention.
Figure 13:
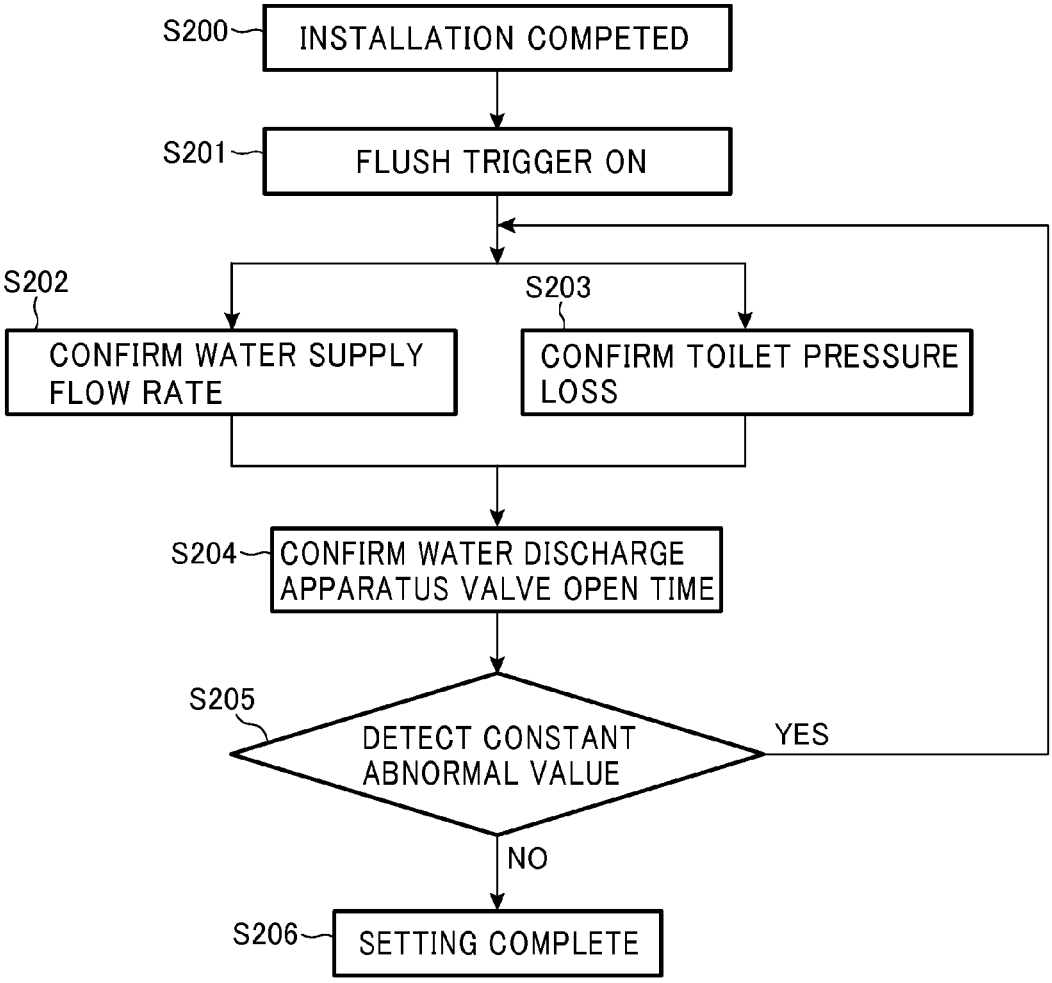
FIG. 13 is a flow chart showing the content of toilet pressure loss learning control using a flush toilet control apparatus according to a third embodiment of the present invention.

Next, referring to FIGS. 12-13, we explain a flush toilet according to a third embodiment of the invention.

FIG. 12 is a summary diagram of a flush toilet according to a third embodiment of the present invention; FIG. 13 is a flow chart showing the content of toilet pressure loss learning control using a flush toilet control apparatus according to a third embodiment of the present invention; and FIG. 14 is a timing chart showing the operation of a flush toilet according to a third embodiment of the present invention.

Here, in flush toilet 200 according to the third embodiment of the invention shown in FIG. 12, the same reference numerals are assigned to those parts which are the same as those of the above-described flush toilet 1 according to the first embodiment of the invention, shown in FIG. 1, and flush toilet 100 according to the second embodiment of the invention, shown in FIG. 7, and an explanation thereof is omitted.

Figure 14:
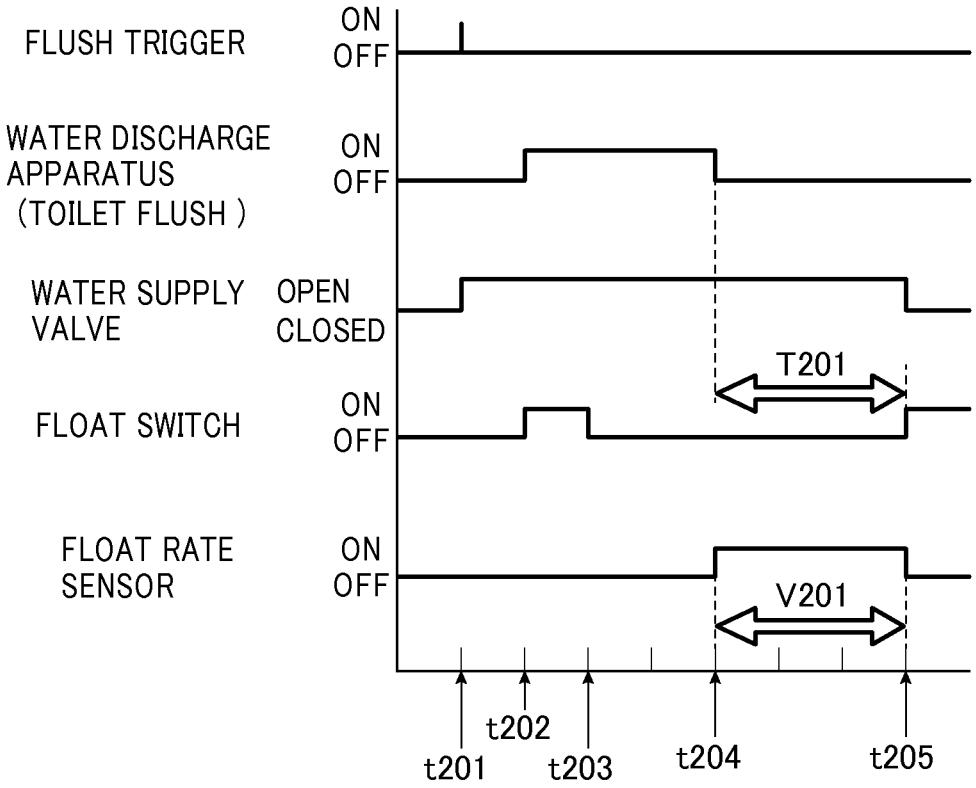
FIG. 14 is a timing chart showing the operation of a flush toilet according to a third embodiment of the present invention.

As shown in FIGS. 12-14, flush toilet 200 according to a third embodiment of the invention differs from the structure of flush toilet 1 according to the second embodiment of the invention, which comprises two float switches 124*a* and 124*b*, in that only one float switch 224, for sensing stopped water level WL201 inside reservoir tank 4, is provided as a water level sensor for sensing the water level inside reservoir tank 4.

Flush toilet 200 according to a third embodiment of the invention differs from the structure of the flush toilet 100 according to the second embodiment of the invention, in which no flow rate sensor is provided, in that a flow rate sensor 256 for sensing the cumulative flow rate V200 [I] of water supplied into reservoir tank 4 from water supply port 32 on water supply apparatus 20 is provided on water supply port 32 of water supply apparatus 20.

Next, referring to FIGS. 12 through 14, we explain the content of toilet pressure loss learning control by a flush toilet control device according to a third embodiment of the present embodiment.

Note that flow charts S200, S201, S205, and S206 showing the content of toilet pressure loss learning control by the control device on a flush toilet according to the third embodiment of the invention shown in FIG. 13 are the same as steps S100, S101, S105, and S106 in the FIG. 8 flow chart showing the content of toilet pressure loss learning control by the control device in a flush toilet according to the second embodiment of the invention, therefore an explanation thereof is omitted.

At time t201 in FIG. 14, water supply valve 30 opens, after which water is supplied into reservoir tank 4 by water supply apparatus 20 until time t205 in FIG. 9.

At time t201 in FIG. 14, the water level in reservoir tank 4 is lower than stopped water level WL201, so float switch 224 is off.

Next, at time t202 in FIG. 14, the water level in reservoir tank 4 rises to stopped water level WL201 and float switch 224 turns on. Then discharge apparatus 22 is driven and opens discharge port 18, while at the same time toilet flushing is started; thereafter from time t202 until time t204 in FIG. 14, overflow pipe 38 and valve member 40 of discharge apparatus 22 are held for a predetermined time (a provisional valve opening time), pulled up to a certain height, and discharge port 18 is released for a predetermined time (a provisional valve opening time). Then flush water inside reservoir tank 4 is supplied to water passageway 8 in toilet main unit 2 and directed to the spout port 10 or rim spout port 16 on bowl portion 6.

Next, after time t202 in FIG. 14, when float switch 224 turns off at time t203, and time t204 in FIG. 14 is reached, discharge apparatus 22 closes discharge port 18. The water level inside reservoir tank 4 at time t203 in FIG. 9 goes to dead water level DWL201. Furthermore, the water level inside reservoir tank 4 after time t204 in FIG. 14 rises from dead water level DWL201 due to the supply of water by water supply apparatus 20, until time t205, when the supply of water is continued by water supply apparatus 20.

In the interval from time t204 to time t205 in FIG. 14, steps S202 and S203 in FIG. 13 are executed simultaneously, and time measurement device 248 senses the water level rise time T200 for the water level to rise inside reservoir tank 4, while flow rate sensor 256 senses the cumulative flow rate V201 [l] supplied into reservoir tank 4 from water supply port 32 on water supply apparatus 20.

At time t205, when the water level inside reservoir tank 4 rises to stopped water level WL201 and float switch 224 turns on, measurement of water level rise time T201 by time measurement device 248, and sensing of water supply cumulative flow rate V201 by flow rate sensor 256, simultaneously end.

In step S202 of FIG. 13, the water supply flow rate Q201 [l/min] (=V201/T201) supplied into reservoir tank 4 by water supply apparatus 20 is calculated using the water level rise time T201 measured by time measurement device 248 and the water supply cumulative flow rate V201 sensed by flow rate sensor 256. This calculated water supply flow rate Q201 data is stored, and step S202 in FIG. 13 is completed.

Simultaneously, in step S203 of FIG. 13, using FIG. 10, which is also employed in flush toilet 100 according to the second embodiment of the invention, the water supply flow rate Q201 calculated in step S202 of FIG. 13 is applied to the relational diagram between water supply flow rate Q101 of water supply apparatus 20, experimentally determined in advance and shown in FIG. 10, and reservoir tank 4 water level rise time T100. Thus in the reference toilet, after discharge apparatus 22 is driven for a predetermined time and flush water is discharged, a calculation is made of the water level rise time T200 from the dead water level DWL201 inside reservoir tank 4, when discharge apparatus 22 has closed the valve, until rising to the initial stopped water level WL201 prior to start of flush.

Next, the ratio (T201/T200) between water level rise time T201 in the flush toilet 200 of the present embodiment measured by control device 226 time measurement device 248 from time t204 to time t205 in FIG. 14, and water level rise time T200 in the reference toilet calculated using FIG. 10, is calculated as toilet pressure loss coefficient K.

The calculated toilet pressure loss coefficient K is then stored, and step S203 of FIG. 13 is completed.

Next, as in step S204 in FIG. 13 of the second embodiment, the toilet pressure loss coefficient K calculated in step S203 of FIG. 13 is applied to the relational diagram between the toilet pressure loss coefficient K experimentally determined in advance and shown in FIG. 11, and water discharge apparatus valve opening time T103, to calculate discharge apparatus 22 valve opening time T203.

Using the flush toilet 200 according to the above-described third embodiment of the invention, in the interval from time t204 to time t205 in FIG. 14, flow rate sensor 256 senses the water supply cumulative flow rate V201 supplied from water supply apparatus 20 water supply port 32 at the same time that time measurement device 248 is measuring water level rise time T201, therefore water supply flow rate measurement device 250 can measure water supply flow rate Q201 (=V201/T201) in the same step that water level rise time T201 is measured by time measurement device 248. Therefore with respect to the water supply flow rate from water source to reservoir tank 4, for example, in comparison to measurement using the measured time for water to accumulate in reservoir tank 4 from a temporarily empty reservoir tank 4 state, and a predetermined reservoir tank 4 capacity, the subject toilet main unit 2 pressure losses (toilet pressure loss coefficient K) can be detected in a short period of time. Also, because pressure losses (toilet pressure loss coefficient K) for the subject toilet main unit 2 are measured by FIGS. 10 and 11 using the water supply flow rate Q201 when measuring by time measurement device 248, a precise detection can be made.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet flushed by stored flush water to discharge waste, comprising:

a reservoir tank for storing flush water;

a toilet main unit including: a water passageway for directing flush water supplied from the reservoir tank, a bowl portion connected to this water passageway, in which a spout port is formed, and a discharge trap pipe;

a water supply apparatus for supplying flush water from a water source into the reservoir tank;

a water discharge apparatus for supplying flush water stored in the reservoir tank to a water passageway in the toilet main unit; and a flush control device configured to control the flushing of the bowl portion by driving the water discharge apparatus to supply flush water stored in the reservoir tank through the water passageway to the spout port;

wherein the flush control device includes a time measurement device configured to measure the water level rise time from a state in which the water discharge apparatus is turned off until a predetermined water level is reached inside the reservoir tank, after the water discharge apparatus is driven for a predetermined time to discharge flush water; and an adjustment device configured to adjust the driving time of the water discharge apparatus in response to pressure losses in the water passageway in the toilet main unit when the bowl portion is flushed out, the pressure losses being calculated based on the water level rise time measured by the time measurement device.

2. The flush toilet according to claim 1, wherein after the water discharge apparatus has been driven for a predetermined time to discharge flush water, the time measurement device measures a first water level rise time for the rise from the water level inside the reservoir tank with the water discharge apparatus in an off state until reaching a predetermined initial water level prior to start of flush.

3. The flush toilet according to claim 2, wherein the adjusting device adjusts the driving time of the water discharge apparatus in response to pressure losses in the water passageway in the toilet main unit by comparing the first water rise time measured by the time measurement device with the water level rise time in a standard toilet.

4. The flush toilet according to claim 3, wherein the flush control device furthermore drives the water discharge apparatus for a predetermined time and places the interior of the reservoir tank in an empty state, then, using the time measurement device, measures a second water level rise time for the rise in the water level inside the reservoir tank from a water discharge apparatus off state, until the water level rises to a predetermined initial water level, wherein the water level rise time in the standard toilet is determined from a first water supply flow rate calculated from the second water level rise time and the capacity of the reservoir tank.

5. The flush toilet according to claim 3, wherein the flush control device executes the respective measurements of the second water level rise time and first water level rise time by the time measurement device continuously, turning off the water supply apparatus before the respective measurements, then activating the water discharge apparatus and starting the supply of flush water into the reservoir tank.

6. The flush toilet according to claim 4, wherein the flush control device again drives the water discharge apparatus for a predetermined time to place the inside of the reservoir tank in an empty state after calculating the first water supply flow rate, then measures a third water level rise time for the water level to rise from the water discharge apparatus off state to the predetermined initial water level inside the reservoir tank using the time measurement device, calculates a second water supply flow rate from this measured third water level rise time and the capacity of the reservoir tank and compares this second water supply flow rate with the first water supply flow rate, and when the second water supply flow rate is equal to or essentially equal to the first water supply flow rate, sets the second water supply flow rate as the water supply flow rate to be used, and when the second water supply flow rate differs greatly from the first water supply flow rate, sets a specified value water supply flow rate with which sufficient flushing capability can be obtained in view of pressure losses in the water passageway in the toilet main unit.

7. The flush toilet according to claim 6, wherein the flush control device further includes a notification device for informing a user that appropriate control is not being implemented when a preset value for water supply flow rate has been set.

8. The flush toilet according to claim 1, wherein the flush control device further includes a water supply flow rate measurement device for measuring the flow rate of flush water supplied from the water supply apparatus to the reservoir tank during a rise in the water level, and the adjusting device adjusts the driving time of the water discharge apparatus in response to pressure losses in the water passageway in the toilet main unit using the first water level rise time measured by the time measurement device, and the water supply flow rate measured by the water supply flow rate measurement device.

9. The flush toilet according to claim 8, wherein the water supply flow rate measurement device includes an upper water level sensor disposed within the reservoir tank, and a lower water level sensor disposed below the upper water level sensor;

and wherein a second water level rise time measures the time to rise from the water level sensed by the lower water level sensor to the water level sensed by the upper water level sensor, and the water supply flow rate is calculated from this second water level rise time and the reservoir tank capacity.

10. The flush toilet according to claim 9, wherein the water level detected by the lower water level sensor is positioned above the water level in the reservoir tank with the water discharge apparatus stopped after the flush control device drives the water discharge apparatus for a predetermined time to discharge flush water.

11. The flush toilet according to claim 9, wherein the water level detected by the upper water level sensor is positioned at the same position as a predetermined water level in the reservoir tank risen from the water discharge apparatus in an off state after the flush control device drives the water discharge apparatus for a predetermined time to discharge flush water.

12. The flush toilet according to claim 8, wherein the water supply flow rate measurement device includes a flow rate sensor for sensing the flow rate when flush water is supplied from the water supply apparatus to the reservoir tank, and the water supply flow rate is measured using this flow rate sensor.

13. The flush toilet according to claim 11, wherein the predetermined water level inside the reservoir tank is the predetermined initial water level prior to start of flush.

14. The flush toilet according to claim 8, wherein the adjusting device adjusts the driving time of the water discharge apparatus in response to pressure losses in the water passageway in the toilet main unit by comparing the water level rise time in a standard toilet determined by water supply flow rate with a first water level rise time measured by the time measurement device.

* * * * *